US009540870B2

(12) United States Patent
Sasaki et al.

(10) Patent No.: US 9,540,870 B2
(45) Date of Patent: Jan. 10, 2017

(54) WINDOW SCREEN WITH BLIND FUNCTION

(71) Applicant: SEIKI JUKO CO., LTD., Shizuoka-shi, Shizuoka (JP)

(72) Inventors: Fumio Sasaki, Shizuoka (JP); Naoto Sawaguchi, Shizuoka (JP)

(73) Assignee: Seiki Juko Co., Ltd., Shizuoka-shi, Shizuoka (JP)

( * ) Notice: Subject to any disclaimer, the term of this patent is extended or adjusted under 35 U.S.C. 154(b) by 0 days.

(21) Appl. No.: 14/762,241

(22) PCT Filed: Jan. 20, 2014

(86) PCT No.: PCT/JP2014/050979

§ 371 (c)(1),
(2) Date: Jul. 21, 2015

(87) PCT Pub. No.: WO2014/115684

PCT Pub. Date: Jul. 31, 2014

(65) Prior Publication Data

US 2015/0368964 A1 Dec. 24, 2015

(30) Foreign Application Priority Data

Jan. 23, 2013 (JP) ..... 2013-010650

(51) Int. Cl.
*E06B 9/08* (2006.01)
*E06B 9/264* (2006.01)
(Continued)

(52) U.S. Cl.
CPC ..... *E06B 9/264* (2013.01); *E06B 9/24* (2013.01); *E06B 9/326* (2013.01); *E06B 9/34* (2013.01);
(Continued)

(58) Field of Classification Search
CPC ..... E06B 9/264; E06B 9/34; E06B 9/56; E06B 9/58; E06B 2009/2423; E06B 2009/2435; E06B 2009/2447; E06B 2009/2452; E06B 2009/2458; E06B 9/26; E06B 9/262; E06B 9/40
See application file for complete search history.

(56) References Cited

U.S. PATENT DOCUMENTS 4,408,650 A * 10/1983 Verch ..... E06B 9/24 160/121.1
5,313,999 A 5/1994 Colson et al.
(Continued)

FOREIGN PATENT DOCUMENTS

EP 0494501 A1 7/1992
JP 63-50389 Y2 12/1988
(Continued)

OTHER PUBLICATIONS

European Search Report for International Application No. 14743712.3 dated Feb. 2, 2016 (7 pages).
(Continued)

*Primary Examiner* — Katherine Mitchell
*Assistant Examiner* — Jeremy Ramsey
(74) *Attorney, Agent, or Firm* — Fitch, Even, Tabin & Flannery, LLP

(57) ABSTRACT

There is provided a window screen configured in such a manner that first and second screens are wound around a winding shaft together with a number of dimming slats attached therebetween in which bottom bars of lower ends of both screens come into stable contact with a lower frame of a screen frame. The first and second screens and the slats attached therebetween at regular intervals so as to be freely tiltable are wound around the winding shaft, both side ends of the first screen engage guide rails so as to be freely slidable, and bottom bars guided individually by side frames
(Continued)

are attached to lower ends of both screens. Both screens are set so that either one of the bottom bars at the lower ends thereof comes into contact with the lower frame of the screen frame in an arbitrary inclined orientation that the above-described slats may have in a state in which both screens are extended in the screen frame in a tensed manner.

19 Claims, 19 Drawing Sheets

(51) Int. Cl.

| | |
|---|---|
| ***E06B 9/54*** | (2006.01) |
| ***E06B 9/34*** | (2006.01) |
| ***E06B 9/326*** | (2006.01) |
| ***E06B 9/52*** | (2006.01) |
| ***E06B 9/58*** | (2006.01) |
| *E06B 9/24* | (2006.01) |

(52) U.S. Cl.
CPC . *E06B 9/52* (2013.01); *E06B 9/54* (2013.01); *E06B 9/58* (2013.01); *E06B 2009/2435* (2013.01)

(56) References Cited

U.S. PATENT DOCUMENTS

| | | | | |
|---|---|---|---|---|
| 5,320,154 | A * | 6/1994 | Colson | E06B 9/171 160/121.1 |
| 5,394,922 | A | 3/1995 | Colson et al. | |
| 5,718,799 | A | 2/1998 | Colson et al. | |
| 6,001,199 | A | 12/1999 | Colson et al. | |
| 6,112,797 | A | 9/2000 | Colson et al. | |
| 6,688,369 | B2 | 2/2004 | Colson et al. | |
| 7,059,378 | B2 | 6/2006 | Colson et al. | |
| 8,291,960 | B2 * | 10/2012 | Bowman | E06B 9/13 160/267.1 |
| 9,133,658 | B2 * | 9/2015 | Kuperus | E06B 9/40 |
| 2001/0037864 | A1 | 11/2001 | Colson et al. | |
| 2004/0149396 | A1 | 8/2004 | Colson et al. | |
| 2006/0180278 | A1 | 8/2006 | Colson et al. | |
| 2007/0039698 | A1 | 2/2007 | Chino et al. | |
| 2014/0138037 | A1 * | 5/2014 | Colson | E06B 9/42 160/290.1 |
| 2015/0047792 | A1 * | 2/2015 | Lukosiunas | E06B 9/26 160/84.05 |

FOREIGN PATENT DOCUMENTS

| | | | |
|---|---|---|---|
| JP | 6350389 | Y2 | 12/1988 |
| JP | 688469 | | 3/1994 |
| JP | 688469 | A | 3/1994 |
| JP | 2758320 | B2 | 5/1998 |
| JP | 2000110462 | A | 4/2000 |
| JP | 2001172841 | A | 6/2001 |
| JP | 4109573 | B2 | 7/2008 |
| WO | 2008127030 | A1 | 10/2008 |

OTHER PUBLICATIONS

International Search Report for International Application No. PCT/JP2014/050979 dated Apr. 1, 2014.

* cited by examiner

WINDOW SCREEN WITH BLIND FUNCTION

CROSS-REFERENCE TO RELATED APPLICATION

This application is a U.S. national phase application of International Application No. PCT/JP2014/050979, filed Jan. 20, 2014, designating the United States, which claims priority to Japanese Patent Application No. 2013-010650, filed Jan. 23, 2013, both of which are incorporated by reference herein in their entirety.

TECHNICAL FIELD

The present invention relates to a window screen with a blind function configured to be installed at a building opening or the like for protection from insects, air ventilation, light-shielding, protection from the sun, prevention of people from seeing the indoor side, and the like.

BACKGROUND ART

For example, as disclosed in Japanese Unexamined Patent Application Publication No. 2000-110462, a window screen configured to be installed at a building opening and provided with a function of a blind capable of varying an angle of inclination of slats is already known.

A screen apparatus including the window screen includes a net or a sheet-type screen to be wound by a winding shaft, a number of slats configured to be attached to one surface side of the screen substantially at regular intervals so as to be freely tiltable, and being coupled at free end sides thereof to a flexible coupling member such as the net at substantially same intervals as intervals of attachment to the screen, and a winding shaft configured to wind the screen by rotation thereof together with the slats, the flexible coupling member and the like attached thereto, and the above-described slats are configured to be tiltable at the free end sides thereof with respect to the screen in a state in which the above-described screen is fed out from the winding shaft and extended in a tensed manner at the building opening.

Japanese Unexamined Patent Application Publication No. 6-88469also discloses the same type.

In the screen apparatus of this type, when extending the flexible coupling member or the like such as the screen, and the slats and the net wound around the winding shaft at the building opening in a tensed manner by rewinding from the winding shaft, the respective slats needs to be capable of retaining a light-shielding state by lying along the screen until a bottom bar provided at a lower end of the screen or the like reaches a lower frame of a screen frame for achieving light-shielding with the slats, and the slats needs to be capable of tilting at the free end sides thereof to a suitable angle of inclination with respect to the screen at least by some operation after the above-described bottom bar reaches the lower frame of the screen frame. In addition, when tilting the slats to a suitable angle of inclination at free end sides thereof in a state in which the above-described bottom bar reaches the lower frame of the screen frame, it is desired that the operation thereof can be performed easily and stably to achieve adjust the angle of inclination of the slats freely while keeping the above-described bottom bar constantly not to separate from the lower frame of the screen frame for preventing rattling due to wind the like or entry of insects.

When a configuration of the screen apparatus disclosed in Japanese Unexamined Patent Application Publication No. 2000-110462 is considered from such a point of view, in the screen apparatus, a single bottom bar 8 is attached between a lower end of a screen 4 to which one end of each of a number of slats 5 is attached, which is wound around a freely rotatable winding shaft 2 and a lower end of a flexible coupling member 6 to which the other end of each of a number of the slats 5 is attached. Therefore, it is superior in terms of simple configuration, but there are following problems caused by this configuration.

In other words, as described above, when a configuration in which the single bottom bar 8 is attached between the lower end of the screen 4 and the lower end of the flexible coupling member 6 is employed, it becomes difficult to adjust lengths of the screen and the flexible coupling member easily in accordance with an opening length of the building opening in a vertical direction to which the screen apparatus is installed. For example, it is difficult to keep the bottom bar attached to the lower end of the screen in stable contact with the lower frame of the screen frame irrespective of an inclined posture of the above-described slats and suppress occurrence of rattling due to wind or the like or significant disfigurement due to formation of a gap between the bottom bar and the above-described lower frame. In the case where an insect preventing net is used as the above-described screen, and the screen apparatus is used as a window screen for a protection from insects, if the gap is formed between the above-described lower frame and the bottom bar, it works as an insect entrance route. In the case where the screen and the flexible coupling member are longer than an opening length of the building opening in the vertical direction, the inclined posture of the slats becomes unstable due to a sagging generated thereby.

As described above, the reason why the gap tends to be formed between the above-described lower frame and the bottom bar is that the posture of the bottom bar 8 is unstable due to wind or the like as a result that the configuration is simplified by attaching the single bottom bar 8 between the lower ends of the screen 4 and the flexible coupling member 6 wound around the winding shaft 2. Therefore, as illustrated in FIGS. 20(A) and (B), an attempt is made to stabilize the posture of the bottom bar 8 by forming a contact surface 8*a* of the bottom bar 8 with respect to the lower frame 9 into an arcuate shape. However, in this case as well, there are disadvantages such that a gap is formed between the bottom bar 8 and the lower frame 9 unless the screen apparatus is installed in site with the lengths of a pair of the screen 4 and the flexible coupling member 6 adapted to a vertical dimension of an inside of the screen frame and, in addition, rattling of the bottom bar 8 due to wind or the like cannot be prevented by a guide or the like.

Patent Literature

PTL 1: Japanese Unexamined Patent Application Publication No. 2000-110462

PTL 2: Japanese Unexamined Patent Application Publication No. 6-88469

SUMMARY OF INVENTION

Technical Problem

A technical problem of the present invention is to provide a window screen with a blind function including: a number of slats for dimming or light-shielding attached at both ends thereof so as to be freely tiltable between a first screen and a second screen which are wound upward by a winding shaft at regular intervals with respect to the respective screens, the slats being wound around the winding shaft together with the above-described both screens in an overlapped manner, bottom bars attached individually to lower ends of the above-described both screens, wherein either one of the bottom bars are configured to come into stable and constant contact with a lower frame of a screen frame irrespective of the posture of inclination of the above-described slats, so that destabilization of posture due to wind or the like, disfigurement due to a gap formed between the bottom bar and the above-described lower frame, and formation of an insect entrance route by the gap are suppressed.

Another technical problem of the present invention is to provide a window screen with a blind function configured not only to function as a window screen for achieving protection from insect and air ventilation, but also to provide a state of protecting the indoor side from the sun or preventing people from seeing the indoor side by covering an entire surface of a screen extending surface in a tensed manner, or to be capable of dimming and light-shielding by an angle adjustment of the slats in a simple configuration.

Solution to Problem

In order to solve the problems described above, according to the present invention, a window screen with a blind function including: a screen unit having: a net-type translucent first screen configured to be wound upward by a winding shaft; a net-type translucent second screen configured to be wound by the above-described winding shaft together with the above-described first screen in an overlapped manner; a number of sheet-type slats for dimming or light-shielding having a constant width and coupled between the above-described first screen and the second screen, the above-described slats being coupled at both ends thereof to the above-described both screens at regular intervals so as to be freely tiltable, and having flexibility so as to be capable of being wound by the above-described winding shaft together with the above-described first and second screens, wherein in the above-described screen unit, each one end of the first and second screens are attached to a peripheral surface of the above-described winding shaft so as to allow the above-described first and second screens can be wound in an overlapped manner, the above-described first screen includes a number of engaging strips attached thereto along left and right side end portions, the engaging strips are engaged in slits of a guide rail on side frames of the screen frame so as to be freely slidable, the above-described first and second screens are provided with first and second bottom bars attached individually to lower ends thereof, at least the first bottom bar attached to the lower end of the above-described first screen makes guide grooves of the above-described side frames guide a vertical movement of the both ends thereof, and the above-described first and second screens have lengths set so that one of the bottom bars at the lower ends thereof comes into contact with a lower frame of the screen frame in an arbitrary inclined posture that the above-described slats can have in a state in which the both screens are extended in the screen frame in a tensed manner.

According to the window screen with a blind function of the present invention having the configuration described above, the first and second bottom bars are attached individually to the lower ends of the first and second screens, at least the first bottom bar makes the guide grooves formed on the above-described side frames guide the vertical movement of the both ends thereof, and, in addition, and the engaging strips of the above-described first screen are engaged in slits of the guide rails on the side frames of the screen frame so as to be freely slidable. Therefore, the first screen may be extended in a tensed manner in a tensed state in the screen frame by the bottom bar at the lower end thereof irrespective of the rewinding state and, in association therewith, the second screen coupled to the first screen by the slats and having the second bottom bar at the lower end thereof are extended in a tensed manner in a tensed state within the screen frame except for a specific state.

In addition, since the lengths of the above-described first and second screens are set so that either one of the bottom bars at the lower ends thereof comes constantly into contact with the lower frame of the screen frame in an arbitrary inclined posture that the above-described slats may have in a state in which the first and second screens are extended in a tensed manner, either one of the bottom bars come into stable contact with the lower frame of the screen frame, so that destabilization of posture due to wind or the like, and disfigurement due to a gap formed between the bottom bar and the above-described lower frame are prevented, and formation of an insect entrance route by the gap are suppressed.

In a preferred embodiment of the above-described window screen with a blind function of the present invention, the above-described first and second screens are attached with respect to the winding shaft to have a dimensional relationship so that a downward movement of the both screens by the rewinding rotation of the above-described winding shaft brings the first and second bottom bars to reach the lower frame of the screen frame simultaneously, or the first bottom bar to reach the same not before the second bottom bar, and then bring the second screen to a reverse winding state with respect to the winding shaft to move the second screen upward with respect to the first screen. Accordingly, the above-described respective slats are formed so as to be capable of having the inclined posture moving upward and downward on a second screen side in a state in which either one of the first and second bottom bars is in contact with the above-described lower frame.

In this configuration, while either one of the bottom bars comes into contact with the lower frame of the screen frame by the downward movement of the both screens, and then the above-described respective slats have the inclined posture by moving upward and downward on the second screen side, either one of the bottom bar comes into stable contact with the lower frame under its own weight in a state in which a wind-up force applied by the screen does not act thereon, and rising of the bottom bar is reliably suppressed unless an excessive winding-up operation is performed.

In another preferred embodiment of the above-described window screen with a blind function of the present invention, the above-described both screens are attached to the above-described winding shaft so as to have a dimensional relationship such that a number of the slats coupled respectively to the both screens hang the second screen with respect to the first screen when the both screens move downward by the rewinding rotation of the above-described winding shaft, whereby the second screen and the second bottom bar at the lower end thereof are supported by the first screen and suspend therefrom.

In this configuration, the above-described first screen engages the slits of the guide rail on the side frames of the screen frame with a number of the engaging strip provided on the left and right side end portions thereof so as to be freely slidable, the left and right side end portions of the second screen are not guided by the side frames and hence are in a free state, but the second screen and the second bottom bar at the lower end thereof are in a state of being hung with respect to the first screen by means of a number of the slats. Therefore, until the bottom bars provided at the lower ends of the both screens reaches the lower frame of the screen frame, the second screen and the second bottom bar are held in a state of being attracted in a direction along the first screen by the gravitational force which is applied thereto and hence are hung and, specifically, the slats are held close to the first screen in almost parallel to each other even though the second screen is not positively held substantially parallel to the first screen. In contrast, as described later, even though the second bottom bar is guided at positions apart from the first bottom bar to some extent, the second screen is held in proximity to the first screen in almost parallel to each other.

In another preferred embodiment of the above-described window screen with a blind function of the present invention, the above-described slats have coupling margins having a certain width in a width direction on both side portions thereof for coupling the first and second screens, and the screen unit is formed in such a manner that when the slats are disposed between the above-described first and second screens so as to overlap with each other and form a planar shape, each slat is coupled to the second screen at a position where a coupling margin of the slat with respect to the second screen overlaps with a coupling margin on one side of an adjacent slat coupled to the first screen and repeating this procedure.

When such a configuration is employed, the second screen and the second bottom bar at the lower end thereof are hung with respect to the first screen by means of a number of slats, and when the second screen and the second bottom bar are suspended in a state of being attracted in a direction along the first screen by a gravitational force which is applied thereto, the respective slats overlap with each other in sequence at the coupling margins on both side portions without generating useless portions for dimming and light-shielding by the slat and, in addition, a number of the above-described slats are arranged at regular intervals, which provides good appearance in design.

In another preferred embodiment of the above-described window screen with a blind function of the present invention, the vertical movement of the both ends of the second bottom bar attached to the lower end of the above-described second screen may be guided in various modes as described below, or the guide may be omitted.

First of all, a first guiding mode is that the vertical movement of the both ends of the second bottom bar attached to the lower end of the above-described second screen is guided by the guide grooves for the second bottom bar provided in proximity to the guide grooves for the first bottom bar formed on the above-described side frames and, in this case, the both guide grooves are formed in proximity in a range in which the first and second bottom bars do not come into contact with each other.

In the first guiding mode, when moving the both screens downward by the rewinding rotation of the above-described winding shaft, as described above, the second screen and the second bottom bar at the lower end thereof are hung with respect to the first screen with a plurality of slats. Therefore, the second screen and the second bottom bar are kept in the state of being attracted by the gravitational force thereof in a direction along the first screen until the bottom bars provided at the lower ends of the both screens reach the lower frame of the screen frame. In addition, if the vertical movement of the both ends of the second bottom bar is guided by the above-described guide grooves in proximity to the guide grooves for the first bottom bar, the slats are kept in almost parallel to the first screen during the downward movement of the both screens, whereby a number of slats are oriented in a state of being as parallel to the first screen as possible during the downward movement of the both screens, so that a shielding property by the slats may be enhanced.

However, since the both ends of the second bottom bar attached to the lower end of the second screen are guided by the guide grooves in proximity to the guide grooves on the first screen, when the second bottom bar at the lower end of the second screen reaches the lower frame and a suspending position of the second screen is moved to a position apart from the first screen by the reverse winding of the second screen by the winding shaft, the second screen is not guided, and hence the second screen is suspended straightly to some extent from the above-described suspending position. However, the second screen is not suspended straightly to the lower portion thereof and has a little sag in a state of being slightly pulled toward the first screen side. There is no functional problem in the case where installation is achieved without making the sag obvious at the lower portion of the screen. However, if a second guiding mode described next is employed, a problem of the sag may be resolved.

The second guiding mode of the above-described window screen with a blind function according to the present invention is a configuration in which the guide grooves on the above-described side frames configured to guide the vertical movement of the both ends of the second bottom bar attached to the lower end of the above-described second screen are provided in proximity to the guide grooves for the first bottom bar formed on the above-described side frames. However, in a lower portion of the guide grooves, the both ends of the second bottom bar are released from the above-described guide grooves in a range in which the both screens are lowered to a range in an inclined posture of the above-described slats can be adjusted and, moreover, a movement-restricting attachment configured to restrict a free movement of the second bottom bar in a direction away from the screen frame from a state of being suspended from the winding shaft is added to a lower portion of the screen frame.

In the second guiding mode, the guide grooves for the second bottom bar at the lower end of the second screen is eliminated. However, since the mode is the same as the first guiding mode within a range where the guide grooves for the second bottom bar exist, the same action as that of the first guiding mode is performed. In the second guiding mode, after the both ends of the second bottom bar have been released from the guide by the above-described guide grooves, a groove width of the guide grooves is increased at the lower portion of the above-described screen frame. However, since the movement-restricting attachment configured to restrict a free movement of the second bottom bar from the state suspended from the winding shaft in a direction away from the screen frame is added, the above-described bottom bar makes the second screen be suspended straightly and hence the partial sag of the lower portion or the like of the above-described second screen is eliminated, and an extreme movement of the second bottom bar due to wind or the like is suppressed by the above-described attachment.

A third guiding mode regarding the vertical movement of the both ends of the second bottom bar has a configuration in which the second bottom bar attached to the lower end of the above-described second screen is hung from the second screen without guiding the vertical movement of the both ends thereof.

In the third guiding mode, the guide grooves configured to guide the vertical movement of the both ends of the second bottom bar do not exist. However, since the second screen and the second bottom bar at the lower end are hung with respect to the first screen by a number of the slats, as described above in conjunction with the above-described first mode, the second screen is kept almost in parallel to the first screen until either one of the bottom bars of the both screens reaches the lower frame of the screen frame. In other words, even though the guide grooves for the second bottom bars do not exist, the same action as described above is performed although there is a probability that the action of the second bottom bar become slightly unstable.

By adding the movement-restricting attachment configured to suppress the extreme movement of the second bottom bar as needed in the same manner as the second guiding mode, the partial sag of the lower portion or the like of the second screen is suppressed, and the undesired free movement of the second bottom bar is also suppressed.

A fourth guiding mode of the second bottom bar of the present invention has a configuration such that a position where the second screen hung from the winding shaft when the above-described second screen is brought into a reverse winding state with respect to the winding shaft after the both screens have been lowered by the rewinding rotation of the above-described winding shaft and a deriving position of the second screen from the winding shaft takes the farthest position from the first screen is defined as the maximum distance position, and the guide grooves configured to guide the vertical movement of the second bottom bar are provided at the positions apart from the guide grooves for the first bottom bar formed on the side frames by a certain length so that the both ends of the second bottom bar are guided by the guide groves.

According to the fourth guiding mode, since the guide grooves for the second bottom bar are provided at positions away from the guide grooves for the first bottom bar, the both ends of the second bottom bars are guided by the guide grooves. However, since the second screen is not guided, the second screen is held in almost parallel to the first screen until the either one of the bottom bars of the both screens reach the lower frame of the screen frame as described above. When the reverse winding of the second screen with respect to the winding shaft starts, since the above-described second bottom bar is guided by the guide grooves, the second screen is extended in a tensed manner in a state of elevating from the second bottom bar guided by the guide grooves. In the case where the guide grooves are at the above-described maximum distance position which is the farthest from the first screen, the second screen is extended in a tensed manner vertically upward from the second bottom bar and the slat is inclined in accordance with the position taken by the upward movement of the second bottom bar.

In another preferred embodiment of the above-described window screen with a blind function of the present invention, in a state in which the first and second screens are wound around the above-described winding shaft in an overlapped manner, a supporting position of the winding shaft in a winding box configured to accommodate the above-described winding shaft is set so that the deriving position of the engaging strips attached along the side end portions of the wound first screen from a surface of the winding screen locates above the guide rails for the engaging strips on the side frames, and in a state in which the second screen is suspended from a peripheral side surface on the opposite side from a deriving side of the first screen in the winding shaft by the rewinding of the both screens from the above-described winding shaft, the supporting position of the winding shaft into the above-described winding box is set so that a suspending position at which the slats attached between the both screens become the longest with respect to the extending position of the above-described first screen in a tensed manner.

As described above, in a window screen with a blind function configured to wind the screen unit by the winding shaft in which both ends of a number of slats attached between the first screen and the second screen which are to be wound upward by the winding shaft in a state in which the both screens overlap with each other, it is desired that the distance between the first and second screens is kept at a suitable distance by the winding shaft in the case where the first and second screens are extended in the screen frame entirely in a tensed manner and the slats are tilted. Therefore, it is suitable to determine the diameter of the winding shaft to be substantially the same as the distance between the above-described slats of the both screens when tilted. However, if the diameter of the winding shaft is set in this manner, since the slats have a width to some extent, a wound diameter of the first and second screens when being wound on the winding shaft in an overlapped manner is increased, so that the capacity of the winding box needs to be increased correspondingly.

Embodiment regarding the supporting position of the winding shaft of the present invention described above is intended to solve the above-described problems. According to the embodiment, the deriving positions of the engaging strips attached to the side end portions of the wound first screen from the surface of the winding screen are located above the guide rail of the engaging strip on the side frames. Therefore, when rewinding the both screens from the winding shaft, the first screen is suspended by being guided by the engaging strips by the above-described guide rails at a position apart from the winding shaft by a distance corresponding to the thickness of the both wound screens. Therefore, a shaft diameter of the winding shaft is reduced and the second screen is suspended from the peripheral side surface opposite from the first screen deriving side on the winding shaft, whereby the distance between the first and second screens may be kept suitably, that is, the wound diameter when the first and second screens are wound in an overlapped manner by reducing the shaft diameter of the winding shaft.

In still another preferred embodiment of the above-described window screen of the present invention, the first bottom bar to be attached to the lower end of the above-described first screen is configured in such a manner that an auxiliary beam for adjusting the dimensions is provided so as to be freely movable in and out from a lower portion of a bottom bar body.

This configuration is effective in the case where a length of the first and second screens is slightly shorter than a vertical length of the building opening to which the window screen is installed for some reason or in the case where a gap is formed between the bottom bar and the lower frame of the screen frame when the first bottom bar at the lower end of the first screen is lowered for eliminating the above-described gap easily without changing the screen unit.

In another preferred embodiment of the above-described window screen of the present invention, at least the above-described first screen is formed of an insect preventing net, and a gap sealing member configured to come into proximity to or contact with the first screen derived from the winding shaft and suppress passage of insects therebetween is disposed at an opening edge of the winding box opposing to the first screen within a range in which the engaging strips at side ends of the first screen engage the guide rail so as to be freely slidable at an opening at a lower portion of the winding box in which the above-described winding shaft is rotatably accommodated from which the first and second screens are derived.

As described above, in the window screen with a blind function configured to use the screen unit including the slats attached between the first and second screens and tilt the above-described slats, if insects or the like enter the winding box from the opening thereof which derives the first screen in the winding box, the insects often enter the indoor side or enter between the first and second screens from the side ends of the screen unit in the winding box, and cannot escape therefrom in many cases. Since these insects are visible from the indoor side through the second screen, the appearance becomes quite bad and, in addition, if dead bodies of the insects are accumulated, therein, the window screen cannot be used any longer.

However, by disposing the simple gap sealing member at a desired position of the winding box described above, entry of insects between the first and second screens or entry of the same from the outside into the indoor side may be suppressed.

In another preferred embodiment of the above-described window screen of the present invention, the above-described slats are formed of a light-shielding sheet and are arrayed so as not to allow light leakage from a gap between the adjacent slats, and the light leakage along the left and right side ends of the first screen is blocked by a light-shielding frame provided on a supporting band for a number of engaging strips to be attached along the left and right side ends of the first screen or the side frames of the above-described screen frames, and a leakage preventing member configured to come in proximity to or in contact with the first screen derived from the winding shaft and suppress light leakage therebetween is also disposed at an opening edge opposing the first screen in the opening from which the first and second screens are derived and formed in the lower portion of the winding box in which the above-described winding shaft is rotatably accommodated.

As described above, in the window screen with a blind function configured to cause the above-described slats to tilt by using the screen unit in which light-shielding slats are attached between the first and second screens, the distance between the first and second screens is significantly larger for allowing the tilting movement of the slats than the case where a single screen is provided. Therefore, the opening formed on a lower surface of the winding box and from which the screens are derived and introduced needs to be increased in size in the direction of the distance between the first and second screens. Therefore, outdoor light is preferably prevented from leaking into the indoor side through this opening.

A main portion where the light leaks as described above is a portion between the slats located in the winding box generated in association with generation of slight sag at an upper end of the first screen when the winding shaft is further rotated slightly after the bottom bar at the lower end of the first screen has fed the both screens from the winding shaft until it comes into contact with the lower frame of the screen frame, or a gap generated between the opening edge opposing the first screen in the opening on the lower portion of the winding box and the first screen. Therefore, by providing the light leakage preventing member as described above, effective inhibition is achieved.

In addition, in another preferred embodiment of the above-described window screen of the present invention, covers intended for protection and dust proofing of the above-described screen unit are added to left and right side frames of the screen frame over ranges of the side frames that the screen unit can be extended in a tensed manner in a vertical direction so as to cover left and right end surfaces between the both screens in a state in which a distance between the first screen and the second screen is the largest and front surface sides of the left and right ends of the second screen.

The above-described screen unit includes a cylindrical space surrounded by the first and second screens and the slats, and prevention of entry of foreign substances into this space needs to be sufficiently considered. The above-described covers are effective not only for resolving such a problem and preventing the entry of foreign substances into the cylindrical space, but also for suppressing damage of the both left and right side ends of the screen units which may be caused by infants or pets.

In another preferred embodiment of the above-described window screen of the present invention, an opening-and-closing operating member configured to achieve a winding and rewinding rotation of the first and second screens by rotating the winding shaft is provided at a shaft end of the above-described winding shaft, and the opening-and-closing operating member is provided with a stopper configured to stop the rotation of the winding shaft before the first bottom bar moves away from the lower frame after having come into contact with the lower frame of the screen frame by an excessive rotation during the rewinding rotation of the above-described winding shaft.

In the above-described window screen with a blind function, although the opening-and-closing operating member configured to achieve the winding and rewinding rotation of the first and second screens by rotating the winding shaft is provided, in the case where the screen unit is operated by using the opening-and-closing operating member, it is relatively difficult to stop the screen unit at a required position. In particular, in the above-described window screen provided with the screen unit, since the one or both of the bottom bars finally come into contact with the winding box when winding the first and second screens, there are comparatively little problems. However, if the excessive rotation occurs during the rewinding rotation of the above-described winding shaft, the both screens might be wound reversely on the winding shaft after the first bottom bar has come into contact with the lower frame of the screen frame. In this case, part of the screen unit may be broken, and hence it is effective for preventing the above-described breakage to stop the rotation of the winding shaft before the first bottom bar moves away from the lower frame.

Advantageous Effects of Invention

According to the window screen with a blind function of the present invention described in detail thus far in which the both ends of a number of the slats for dimming or light-shielding are attached between the first screen and the second screen, which are wound upward by the winding shaft, are attached to the respective screens at regular intervals so as to be freely tiltable, and the slats are wound around the winding shaft together with the above-described both screens in an overlapped manner, either one of the bottom bars attached individually to lower ends of the above-described both screens, wherein one of the bottom bars are configured to come into stably and constantly contact with the lower frame of the screen frame irrespective of the posture of inclination of the above-described slats, so that destabilization of posture due to wind or the like, disfigurement due to a gap formed between the bottom bar and the above-described lower frame, and formation of an insect entrance route by the gap are suppressed. Also, in a simple configuration, a window screen with a blind function configured not only to function as a window screen for achieving protection from insect and air ventilation, but also to provide a state of protecting the indoor side from the sun or preventing people from seeing the indoor side by covering an entire surface of a screen extending surface in a tensed manner by the slats, or to be capable of dimming and light-shielding by an angle adjustment of the slats is provided.

DESCRIPTION OF EMBODIMENTS

Figure 1:
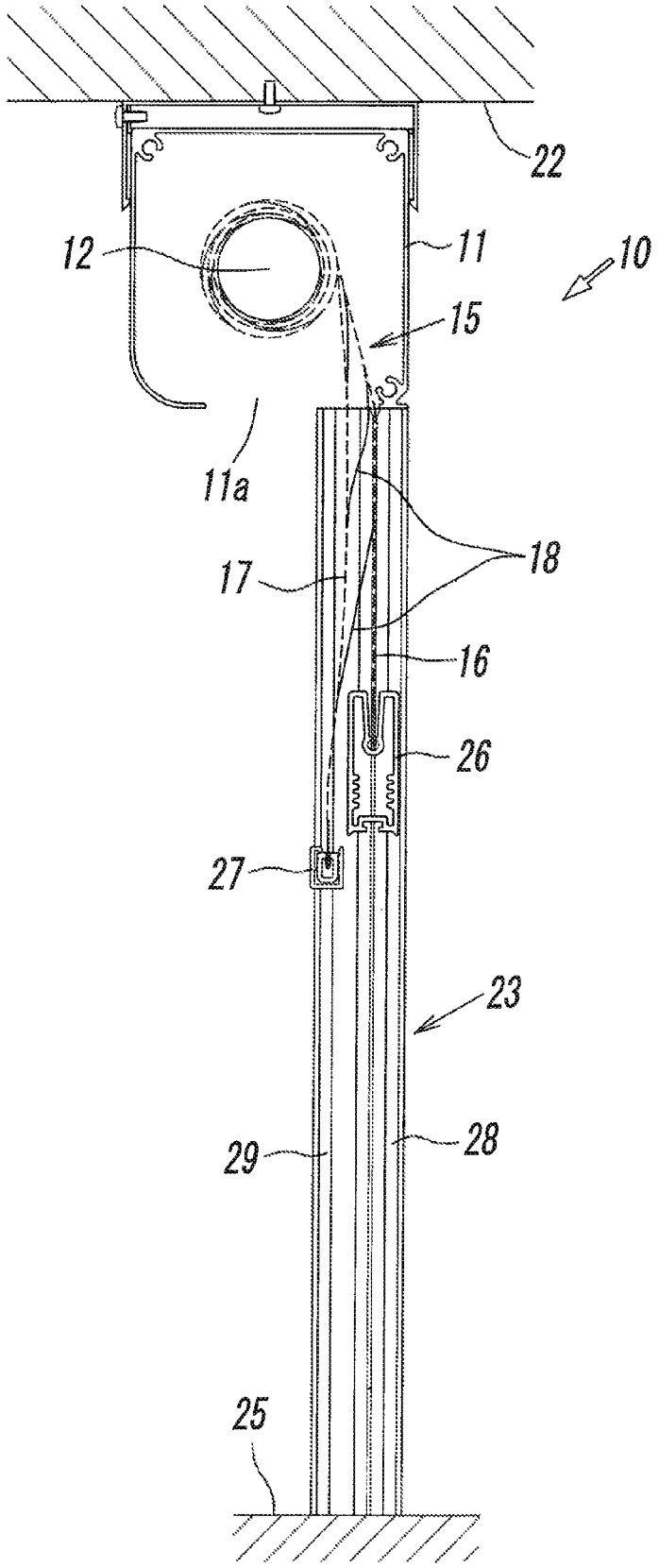
FIG. 1 is a cross-sectional side view of a window screen with a blind function of the present invention schematically illustrating a state in which feeding of the screen from a winding shaft is started according to a first embodiment.

FIG. 1 to FIG. 8 are drawings illustrating a window screen with a blind function according to a first embodiment of the present invention.

The first embodiment of the present invention and respective embodiments described below include, as a basic configuration, a screen unit 15 including a net-type first screen 16 formed of a translucent material configured to be wound upward by a winding shaft 12 supported in a winding box 11 so as to be freely rotatable; a net-type second screen 17 formed of a translucent material configured to be wound around the above-described winding shaft 12 together with the above-described first screen 16 in an overlapped manner; and a number of sheet-type slats 18 for dimming or light-shielding having a constant width and coupled between the above-described first screen 16 and the second screen 17, the above-described slats 18 being coupled at both ends thereof to the above-described both screens 16, 17 at regular intervals so as to be freely tiltable, and having flexibility so as to be capable of being wound around the above-described winding shaft 12 together with the above-described first and second screens 16, 17.

FIG. 1 to FIG. 5 schematically illustrate a state in which feeding of the first and second screens 16, 17 from the winding shaft 12 is started and orientation of a number of slats 18 is rotated up to a turning extremity in the above-described first embodiment in which the screen unit 15 described above is used as described below in detail.

Figure 2:
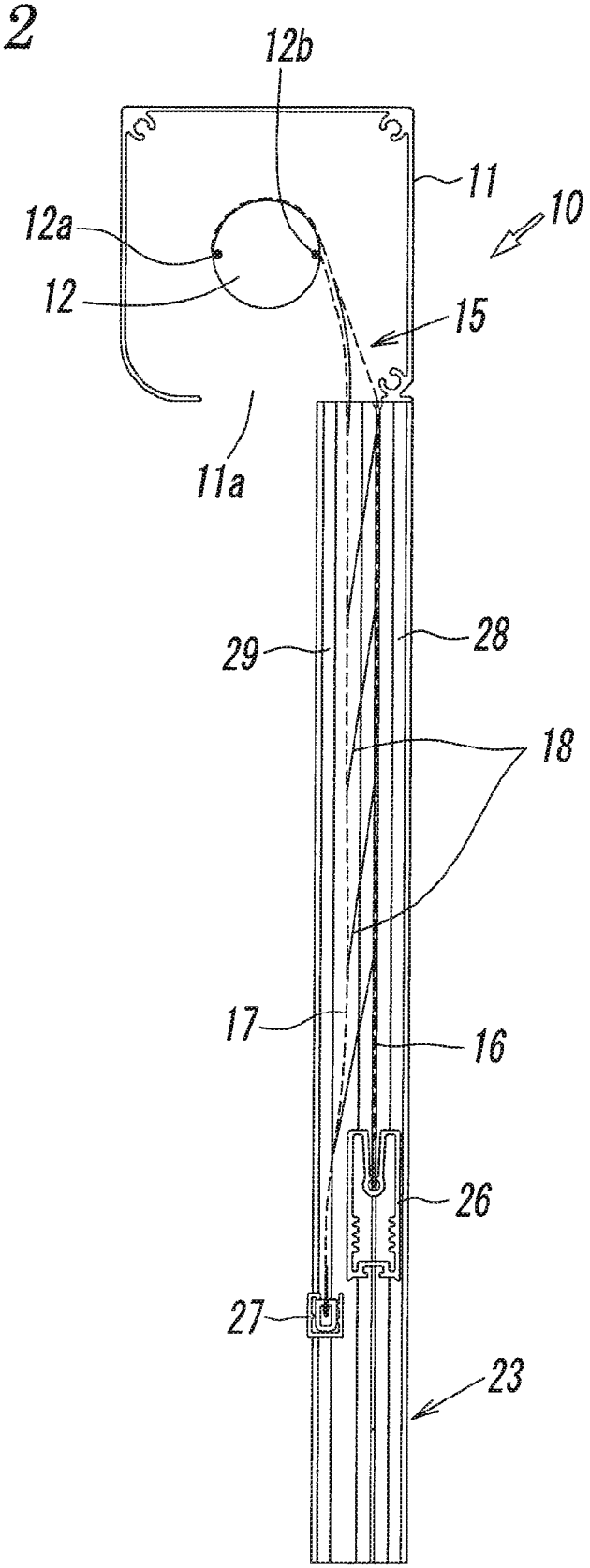
FIG. 2 is a cross-sectional side view of the same in which feeding of the screen is further advanced from the state in FIG. 1.
Figure 6:
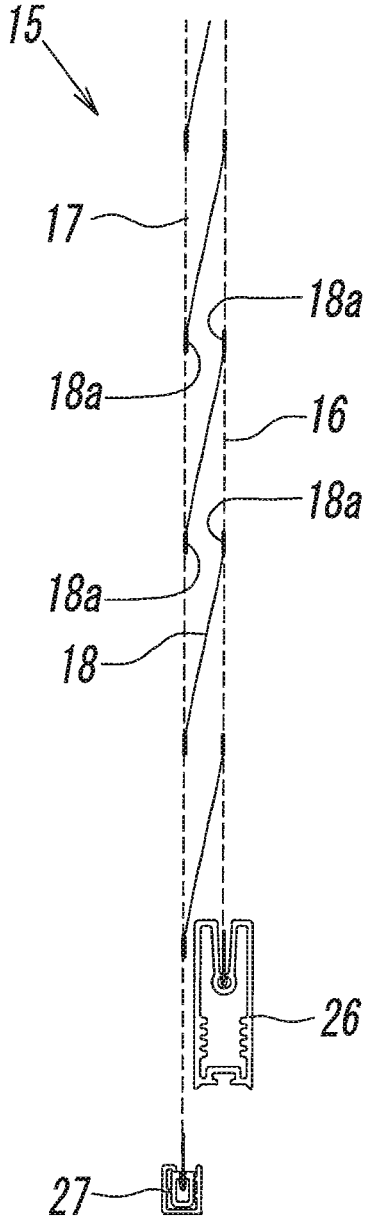
FIG. 6 is an explanatory drawing of a principle portion of a configuration of a screen unit used in the window screen of the present invention.
Figure 7:
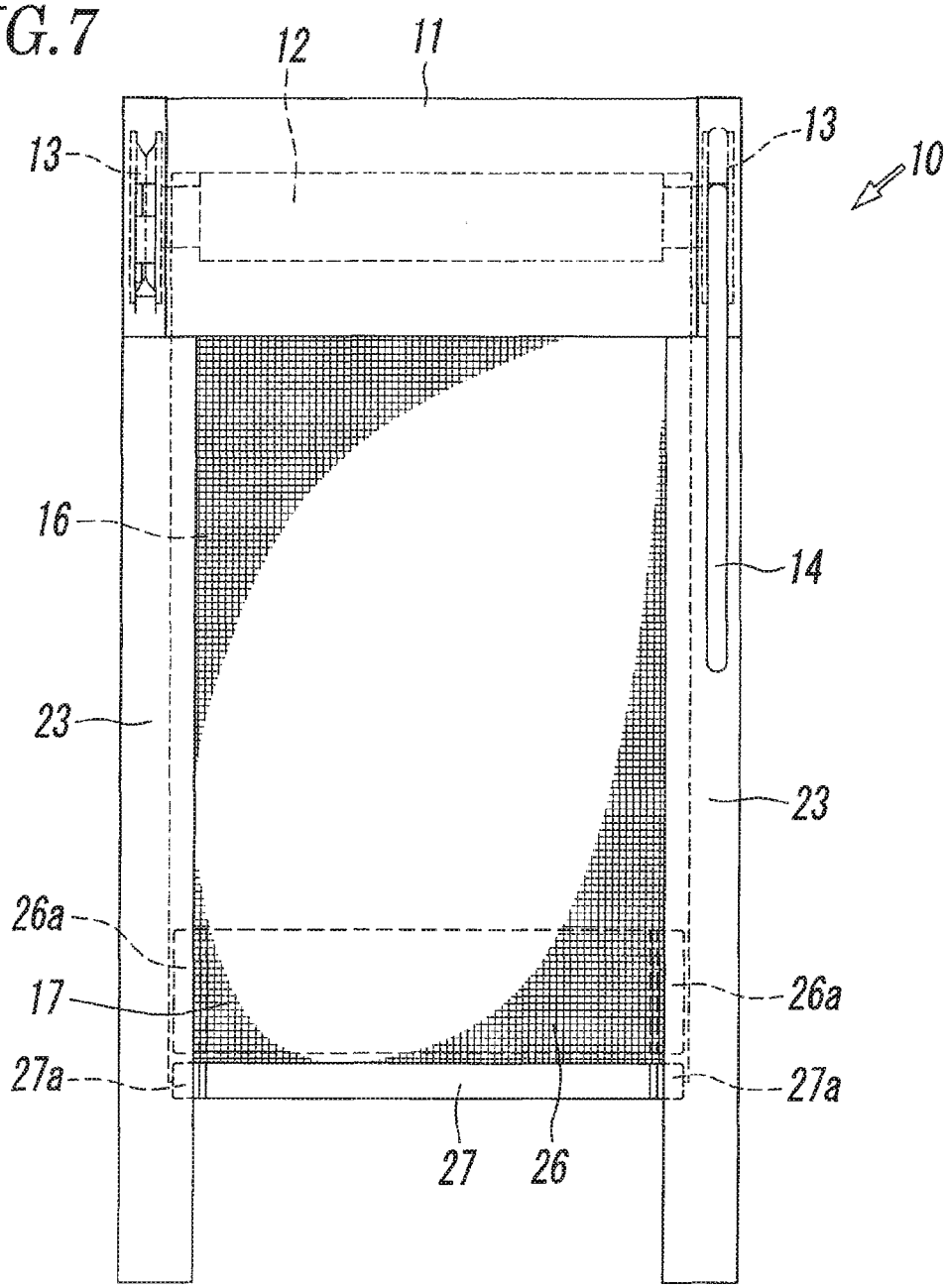
FIG. 7 is a schematic front view of the window screen with a blind function in the state illustrated in FIG. 2.
Figure 8:
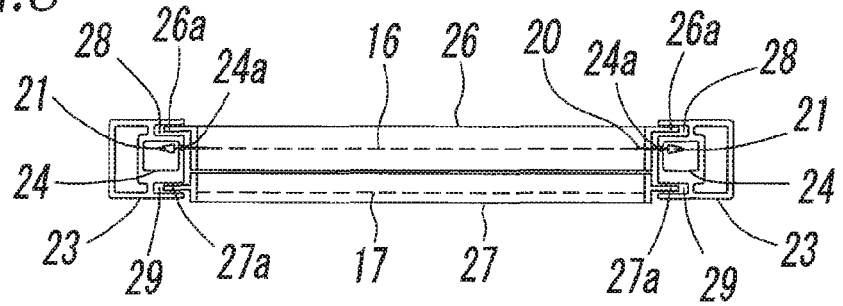
FIG. 8 is a horizontal cross-sectional view of the same.

In addition, FIG. 6 is a coupling structure between the first and second screens and the slats in the above-described screen unit 15, and FIG. 7 and FIG. 8 illustrate a configuration of a window screen 10 in the state illustrated in FIG. 2 by a front view and a horizontal cross-sectional view.

With reference to these drawings, the above-described first embodiment will be described in detail. First of all, the above-described window screen 10 is formed in such a manner that the above-described screen unit 15 configured to be wound by the winding shaft 12 which is supported in the winding box 11 so as to be freely rotatable includes the above-described first screen 16 arranged on an outdoor side and the second screen 17 arranged on an indoor side overlapped with each other, and a number of the slats 18 coupled therebetween are arranged in a planar state and parallel to the both screens 16, 17, and in this state, each one of end of the first and second screens 16, 17 are attached to a predetermined position described later on a peripheral surface of the above-described winding shaft 12, and the other end of each of the first and second screens 16, 17 wound by the winding shaft 12 is derived downward from an opening 11*a* on a lower surface of the above-described winding box 11.

The above-described first and second screens 16, 17, specifically, the material of the first screen 16 arranged on the outdoor side of the building opening may be selected according to the object of usage of the window screen from suitable material such as the one superior in decoration, the one having a light-shielding property to some extent, the one having a fine mesh-type configuration which blocks pollen, for example as long as it is a net-type and has translucency, which secure prevention of insects and air ventilation. The first and second screens may be of the same material and may be of different materials and, in the case of being formed of the same material, may be used a series of screen materials continuing on the periphery of the winding shaft 12. The second screen 17 does not need to have a configuration which prevents entry of the insects.

The above-described first screen 16 out of the first and second screens 16, 17, which is arranged on the outdoor side includes, as illustrated in FIG. 8, a number of engaging strips 21 held by supporting bands 20 formed of a cloth or a synthetic resin along left and right side end portions. The engaging strips 21 are engaged with slits 24*a* provided on guide rails 24 on side frames 23 of the screen frame so as to be freely slidable so that a vertical movement in a state of holding the left and right side end portions of the above-described first screen 16 is guided. A number of the engaging strips 21 to be held by the above-described supporting bands 20 may be, for example, halves of a sliding fastener to be joined with each other, which is in heavy usage in clothes, or members corresponding thereto. In contrast, a number of the engaging strips held by the above-described supporting band are not attached to left and right side end portions of above-described the second screen 17, and hence the second screen 17 is not guided by the side frames 23 and is in a free state.

A number of the above-described engaging strips 21 attached along the side end portions of the above-described screen 16 are effective for suppressing the screen 16 from being blasted by a wind acting thereon, and specifically, the first screen 16 is formed of an insect preventing net, so that entry of insects from the left and right side ends of the first screen 16 is prevented simultaneously in a case where the window screen 10 is functioned as an insect preventing window screen.

The above-described first and second screens 16, 17 include first and second bottom bars 26, 27 attached individually to lower ends thereof, and at least the first bottom bar 26 attached to the lower end of the above-described first screen 16 includes guide portion strips 26*a* projecting from both ends fitted into guide grooves 28 provided vertically on the above-described side frames 23, so that the vertical movement of the bottom bar 26 is guided by the side frames 23. In contrast, the above-described second bottom bar 27 attached to the lower end of the second screen 17 is, as described later with reference to embodiments illustrated in FIG. 9 to FIG. 11, only needs to guide the vertical movement of both ends thereof as needed. However, in the above-described first embodiment, guide portion strips 27*a* projecting from both ends of the above-described second bottom bar 27 are fitted into guide grooves 29 provided vertically on the above-described side frames 23, whereby the vertical movement of the bottom bar 27 is guided by the side frames 23.

In particular, in the first embodiment, in comparison with other exemplary embodiment, the guide grooves 29 configured to guide the vertical movement of the guide portion strips 27*a* at both ends of the second bottom bar 27 are provided in proximity to the guide grooves 28 of the first bottom bar 26 on the above-described side frames 23. In other words, since the both guide grooves 28, 29 are formed so that the first and second bottom bars 26, 27 are sufficiently in proximity to each other without mutual contact, the second bottom bar 27 to be hung by a number of the slats 18 with respect to the first screen 16 via the second screen 17 is suspended at a position close to the first screen 16 in a stage in which the first and second screens 16, 17 are moved downward by the rewinding of the winding shaft 12, so that the second screen 17 is held in a state of overlapping with the first screen 16 in almost contact therewith.

The screens are extended in a tensed manner in a tensed state.

The first screen 16 makes the engaging strips 21 on the left and right side end portions engage with the guide grooves 28 on the guide rails 24 on the side frames 23 of the screen frame so as to be freely slidable and cause the vertical movement of the first bottom bar 26 to be guided by the side frames 23, the first screen 16 can be extended in a tensed manner in a tensed state by the first bottom bar 26 irrespective of the rewinding state and, accordingly, the second screen 17 coupled to the first screen 16 via the slats 18, and having the second bottom bar 27 attached to the lower end thereof is also extended in a tensed manner in a tensed state within the screen frame except for a specific state after having reached a lower frame 25.

The above-described bottom bars 26, 27 are provided with weights so as to suppress the first and second screens 16, 17 from being blasted by wind and keep the same in a tensed state. However, if the weight is not sufficient, heavy bobs may be accommodated in the indoor side thereof.

In addition, in the above-described screen unit 15, since a number of the slats 18 are attached between the first and second screens 16, 17, specifically, when the slats are in parallel to both of the first and second screens 16, 17, the first and second screens 16, 17 are subjected to an action of a blast or the like of wind entirely. However, since the first and second bottom bars 26, 27 are individually attached to lower ends of the both screens 16, 17 and, in addition, the engaging strips 21 of the above-described first screen 16 engage the guide grooves 28 of the side frames 23 of the screen frame so as to be freely slidable to guide the vertical movement of the first bottom bar 26. Therefore, swinging of the screens 16, 17 is effectively suppressed, thereby functioning effectively to suppress swinging of the screen unit as a whole.

Between the above-described first screen 16 and the second screen 17, a number of slats 18 formed of a light-shielding material or a material having a limited translucency and configured to prevent people from seeing the indoor side are attached so as to be freely tiltable at regular intervals. However, coupling between the slats 18 and the above-described first and second screens 16, 17 is preferably achieved by providing the above-described respective slats 18 with coupling margins 18*a* having a constant width in a width direction on both side portions thereof for coupling the first and second screens, and the screen unit 15 is formed in such a manner that when the slats 18 are disposed between the above-described first and second screens 16, 17 so as to overlap with each other and form a planar state, each slat 18 is coupled to the second screen 17 at a position where a coupling margin 18*a* of the slat 18 with respect to the second screen 17 overlaps with a coupling margin 18*a* on one side of an adjacent slat 18 coupled to the first screen 16 and repeating this procedure as illustrated in FIG. 6. Coupling between the coupling margins 18*a* of the respective slats 18 and the both screens 16, 17 may be achieved by weaving or knitting of lines which constitute these members with each other, adhesion of thereof, other joints, and the like.

When such a configuration is employed in the screen unit 15, the second screen 17 and the second bottom bar 27 at the lower end thereof are hung with respect to the first screen 16 by means of a number of slats 18, and when the second screen 17 and the second bottom bar 27 are suspended in a state of being attracted in a direction along the first screen 16 by a gravitational force which is applied thereto, the respective slats 18 overlap with each other in sequence at the coupling margins 18*a* on both side portions for ensuring dimming and light-shielding by the slats and, in addition, a number of the above-described slats 18 are arranged at regular intervals, which provides good appearance in design.

A coupling mode between the first and second screens 16, 17 and the slats 18 is not limited to a configuration described above with reference to FIG. 6 and, for example, in order to secure a sufficient light-shielding state in a case where the above-described slats 18 have a posture substantially parallel to the both screens 16, 17, a mounting interval of the portions of the slats having a light-shielding property with respect to the above-described both screens 16, 17 needs to be the same or smaller than the width of the light-shielding portion, and a mounting width of the slats can be set within the range adequately.

The slats 18 are configured to be wound on the winding shaft 12 together with the above-described both screens 16, 17, when being wound, it is necessary to have flexibility so as to be wound along a peripheral surface of a cylinder of the winding shaft 12. However, when the both screens 16, 17 are rewound from the winding shaft 12, the slats 18 are almost in a planar state, and need to be formed of the material which has a function of light-shielding or dimming described above.

Figure 4:
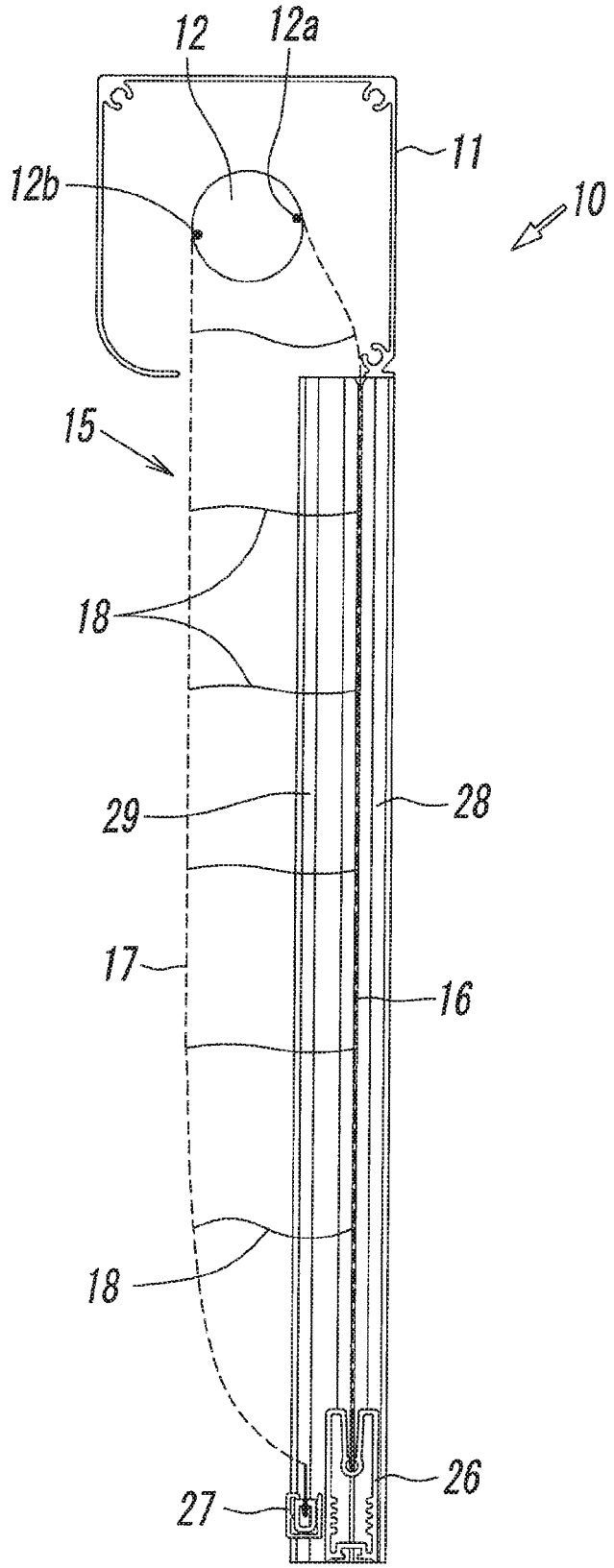
FIG. 4 is a cross-sectional side view of the same illustrating a state in which a rotation of the winding shaft is further advanced from the state in FIG. 3, and slats reach a substantially horizontal state.
Figure 5:
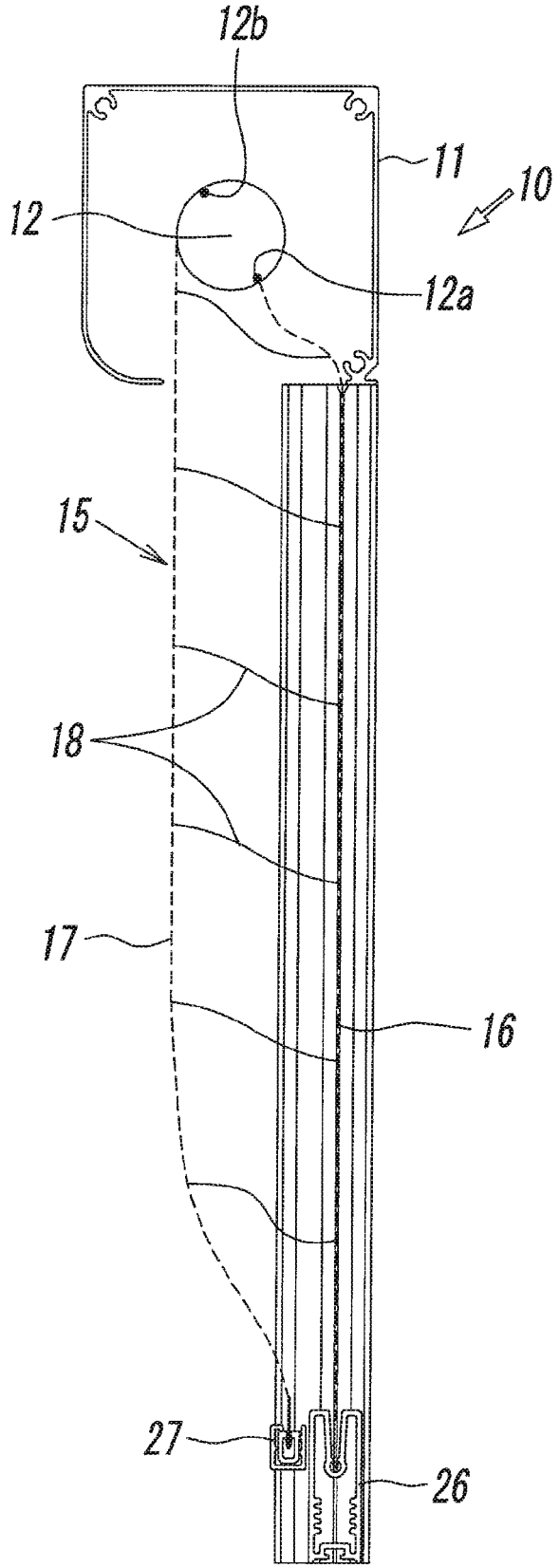
FIG. 5 is a cross-sectional side view of the same illustrating a state in which the rotation of the winding shaft is further advanced from the state in FIG. 4, and the slats reach a turning extremity.

In addition, when the width between the above-described screens 16, 17 varies with the tilting movement of the slats 18 by the rotation of the winding shaft 12, the slats 18 receives a force in the width direction. Therefore, it is estimated that the slats are bent to some extent as illustrated in FIG. 4 and FIG. 5. In such a case, it is not preferable in terms of appearance that a number of the slats are bent at random, and hence a constant bent curl is preferably provided in advance.

Figure 15:
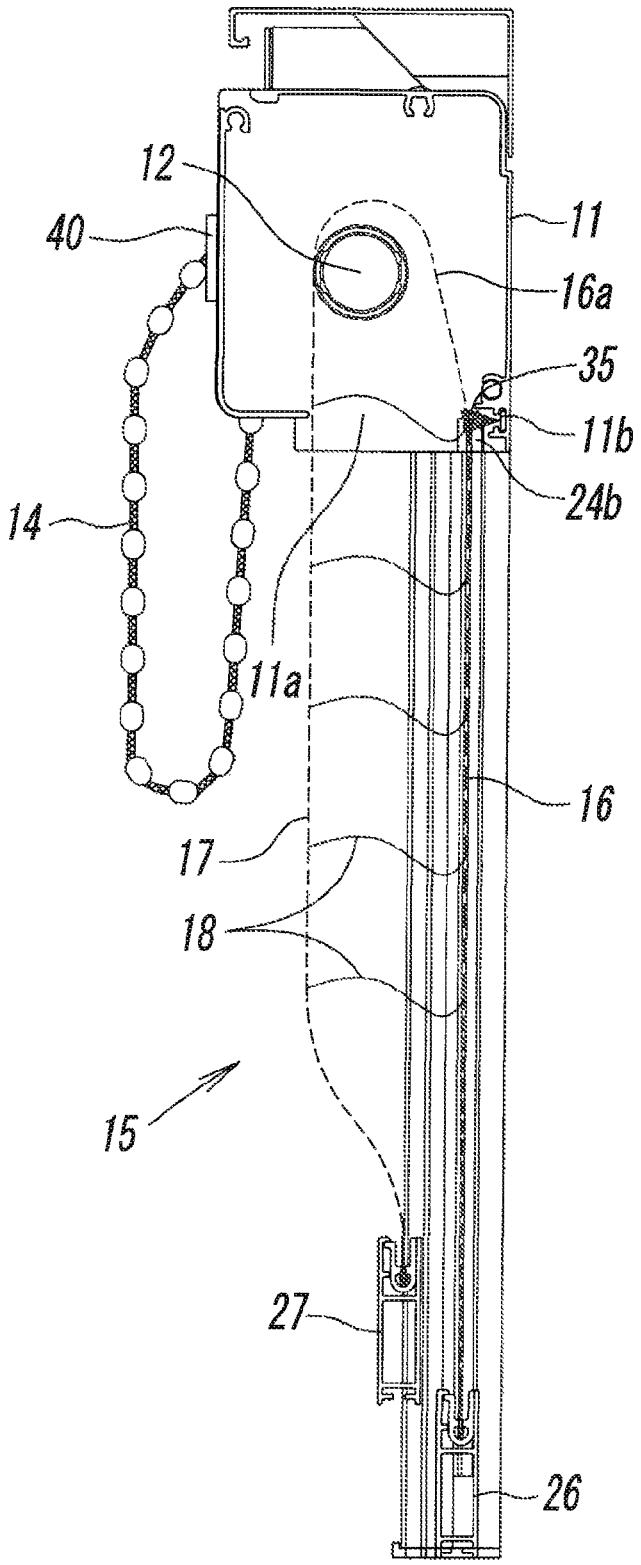
FIG. 15 is a schematic cross-sectional side view of a seventh embodiment in which a gap sealing member configured to prevent entry of insects between the first and second screens of an indoor side and the screen unit.
Figure 16:
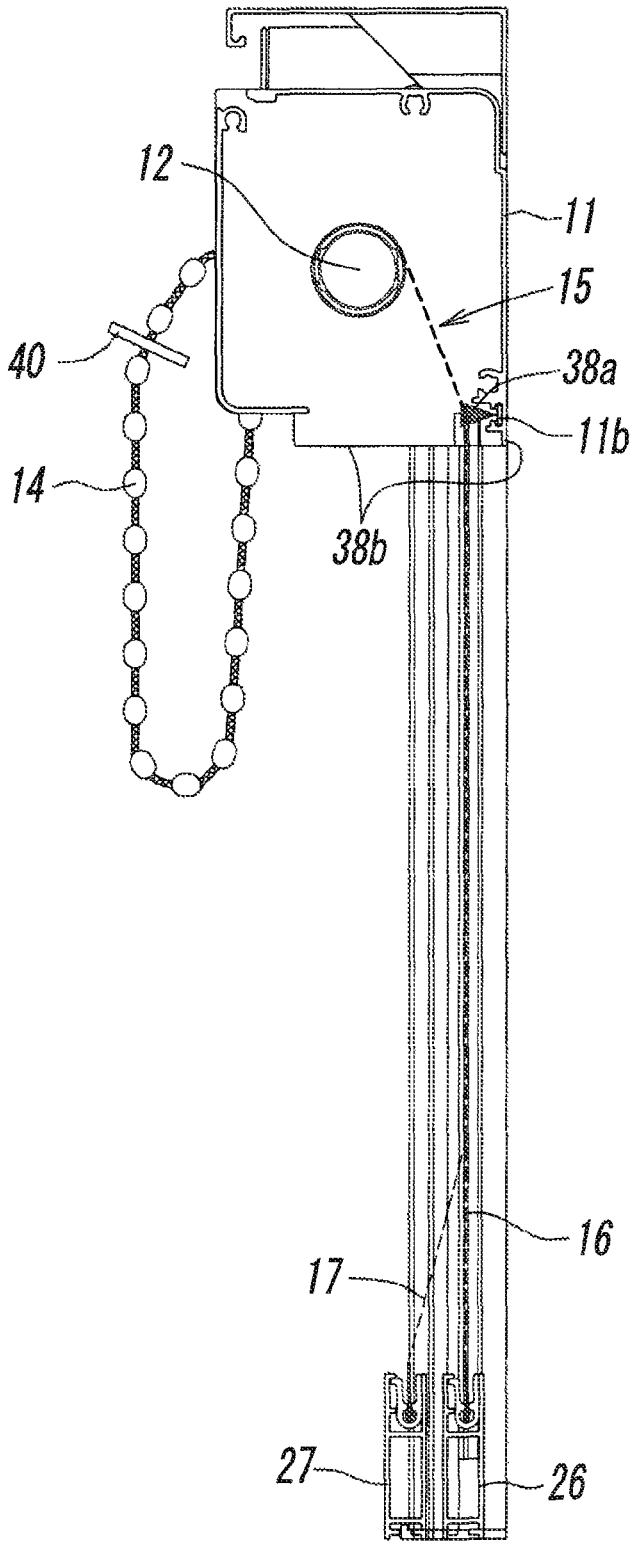
FIG. 16 is a schematic cross-sectional side view of an eighth embodiment in which a light leakage preventing member configured to suppress light leakage from between adjacent slats is disposed.

The above-described winding box 11 described above is attached along an upper frame 22 or the like of the building opening illustrated in FIG. 1 and so force, and the winding shaft 12 supported in the indoor side of the winding box 11 so as to be freely rotatable is provided with an opening-and-closing operating member configured to perform a winding and rewinding rotation of the first and second screens 16, 17 by rotating the winding shaft at a shaft end thereof. FIG. 7 illustrates a structure of the opening-and-closing operating member supported so as to be capable of rotating in forward and reverse directions by an operating cord 14 wound around either one of pulleys 13 provided at both shaft ends of the winding shaft 12. However, continuous beads type or other types of operating cord 14 as illustrated in FIG. 15 and FIG. 16 may be employed, and the operating cord 14 is not limited to an operating cord which is referred to as a "cord" or the like, but an operating tab, a handle, and other structures may be employed as well.

Subsequently, attachment positions or a dimensional relationship of the both screens 16, 17 will be described when attaching the above-described first and second screens 16, 17 with respect to the above-described winding shaft 12.

First of all, as apparent from FIG. 1 and FIG. 2, basically, the above-described first and second screens 16, 17 are attached to the above-described winding shaft 12 so as to have a dimensional relationship such that a number of the slats 18 coupled respectively to the both screens 16, 17 hung the second screen 17 having the second bottom bar 27 at the lower end thereof with respect to the first screen 16 when the both screens 16, 17 move downward by the rewinding rotation of the above-described winding shaft 12, whereby the second screen 17 and the second bottom bar 27 at the lower end thereof are supported by the first screen 16 and suspended therefrom.

The dimensional relationship can be set easily by adjusting the attachment position at the upper ends of the first and second screens 16, 17 with respect to the winding shaft 12. However, as described below, it is necessary to form these members so that the above-described respective slats 18 can have an inclined posture by a vertical movement on the second screen 17 side in a state in which either one of the first and second bottom bars 26, 27 is in contact with the lower frame 25 of the screen frame. In the case where the first and second screens 16, 17 are formed of the same series of screen material, since the wind-up operation by the reverse winding of the second screen 17 needs to be considered. Therefore, the first and second screens 16, 17 can not necessarily fixed to a single position in the periphery of the winding shaft 12, and positioning is facilitated by taking attachment at a plurality of positions into account.

In FIG. 2 to FIG. 5, the respective attachment positions of the first and second screens 16, 17 with respect to the winding shaft 12 are shown by reference signs 12*a*, 12*b*.

The above-described first and second screens 16, 17 needs to be attached to the winding shaft 12 to have a dimensional relationship so that a downward movement of the both screens by the rewinding rotation of the above-described winding shaft brings the first and second bottom bars 26, 27 to reach the lower frame 25 of the screen frame simultaneously, or the first bottom bar 26 to reach the same before the second bottom bar 27, and then bring the second screen 17 to a reverse winding state with respect to the winding shaft 12 as illustrated in FIG. 4 and FIG. 5 to move the second screen 17 upward with respect to the first screen 16.

In this state, the lengths of the above-described first and second screens 16, 17 are spontaneously set so that either one of the bottom bars 26, 27 at the lower ends thereof come into constant contact with the lower frame 25 of the screen frame in a given inclined posture that the above-described slats 18 can have in a state in which the first and second screens 16, 17 are extended in the screen frame in a tensed manner, that is, as will be understood from FIG. 4 and FIG. 5 described above, the above-described slats 18 may have the inclined posture by moving vertically on the second screen 17 side in a state in which either one of the first and second bottom bars 26, 27 is in contact with the above-described lower frame 25 of the screen frame. Therefore, in a state in which either one of the bottom bars comes into stable contact with the lower frame 25 of the screen frame under its own weight without an application of a wind-up force applied by the screen, so that destabilization of posture due to wind or the like, disfigurement due to a gap formed between the bottom bar and the above-described lower frame 25, and formation of an insect entrance route by the gap are suppressed.

The lower frame of the above-described screen frame corresponds to the lower frame of the building opening to which the window screen 10 is to be installed in the case where the lower frame as part of the window screen 10 is not provided between the lower ends of the above-described left and right side frames 23, 23.

In the above-described first embodiment, as described above, the first screen 16 makes a number of the engaging strips 21 provided on the left and right side end portions thereof engage the guide rails 24 on the side frames 23 of the screen frame so as to be freely slidable, while the left and right side end portions of the second screen 17 are in the free state without being guided by the side frames 23.

However, since the second screen 17 and the second bottom bar 27 at the lower end thereof are in the hung state by a number of slats 18 with respect to the first screen 16, as illustrated in FIG. 1 and FIG. 2, the second screen 17 and the second bottom bar 27 are suspended by being held in a state of being attracted in a direction along the first screen 16 by a gravitational force applied thereto.

Therefore, even though the second screen 17 is not positively held in a state almost to parallel to the first screen 16, the slats 18 are held in proximity to the first screen 16 in almost parallel thereto, so that a dimming property or a light-shielding property may be secured by the slats 18.

As described later with reference to FIG. 11, even though the second bottom bar 27 is guided by the guide grooves 29 at positions apart from the first bottom bar 26 to some extent, the second screen 17 is held in proximity to the first screen 16 in almost parallel thereto by the same mechanism as described above.

Figure 3:
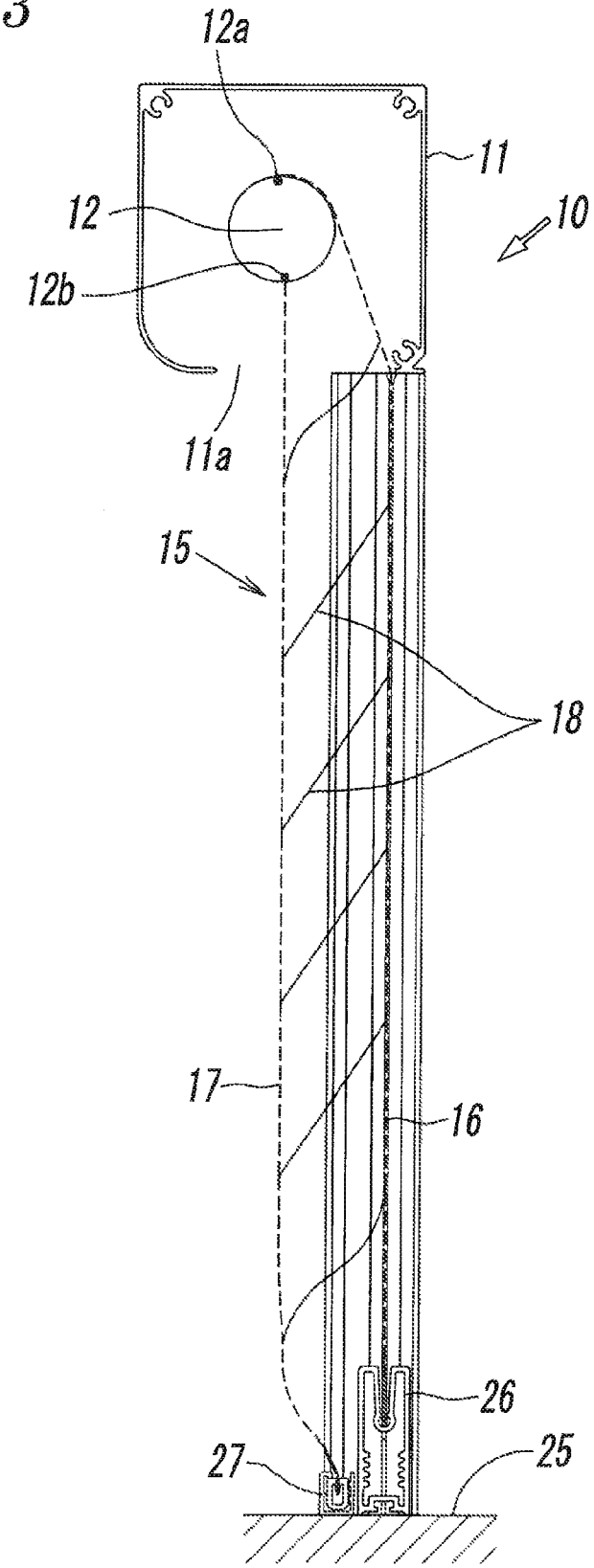
FIG. 3 is a cross-sectional side view of the same in which feeding of the screen is further advanced from the state in FIG. 2, and a bottom bar reached a lower frame.

The lengths of the first and second screens 16, 17 wound on the above-described winding shaft 12 in an overlapped manner will be described further in detail. As understood from FIG. 2 to FIG. 5, the lengths of the both screens 16, 17 have a dimensional relationship such that the bottom bar 26 at the lower end of the first screen 16 reaches the lower frame preferably after the bottom bar 27 at the lower end of the second screen 17 has reached the lower frame 25 of the screen frame ahead of the bottom bar 26 when rewinding the first and second screens 16, 17 by the rotation of the above-described winding shaft 12, and, by the further rotation of the winding shaft 12 of the winding shaft 12, are set so that the upper end of the second screen 17 is wound upward by the winding shaft 12 in a reverse rotation by the rotation of the winding shaft 12 as illustrated in FIG. 3 to FIG. 5 in a state in which the bottom bar 26 at the lower end of the first screen 16 is in contact with the above-described lower frame, and the above-described slats 18 have a posture to move upward on the second screen 17 side accordingly, whereby the distance between the first and second screens 16, 17 is increased.

In the above-described first embodiment, as is clear from FIG. 1 to FIG. 5 and FIG. 8, the vertical movement of the both ends of the second bottom bar 27 attached to the lower end of the second screen 17 is guided in accordance with the first guiding mode and, more specifically, the vertical movement of the both ends of the above-described second bottom bar 27 is guided by the guide grooves 29 of the second bottom bar 27 provided in proximity to the guide grooves 28 for the first bottom bar 26 formed on the side frames, and the both guide grooves 28, 29 are formed sufficiently close to a range in which the first and second bottom bars 27 do not come into contact with each other.

In the first guiding mode, when moving the both screens downward by the rewinding rotation of the above-described winding shaft 12, the second screen 17 and the second bottom bar 27 are kept in a state of being attracted in a direction along the first screen 16 until the bottom bars 26, 27 of the both screens 16, 17 reach the lower frame 25 of the screen frame as described above.

However, since the both ends of the second bottom bar 27 attached to the lower end of the second screen 17 is guided by the guide grooves 29 in proximity to the guide grooves 28 on the first screen 16, when the second bottom bar 27 reaches the lower frame 25 and a suspending position (attachment position 12*b* to the winding shaft) of the second screen 17 is moved to a position apart from the first screen 16 by the reverse winding of the second screen 17 by the winding shaft 12, since the second screen 17 is not guided, the second screen 17 is suspended straightly to some extent from the above-described suspending position. However, since the second screen includes the second bottom bar 27 attached to the lower end thereof, the second screen is not suspended straightly to the lower portion thereof and has a little sag in a state of being slightly pulled toward the first screen 16 side as illustrated in FIG. 4 and FIG. 5. If there is a problem in the sag, it can be resolved by employing a second guiding mode or the like given below.

Figure 9:
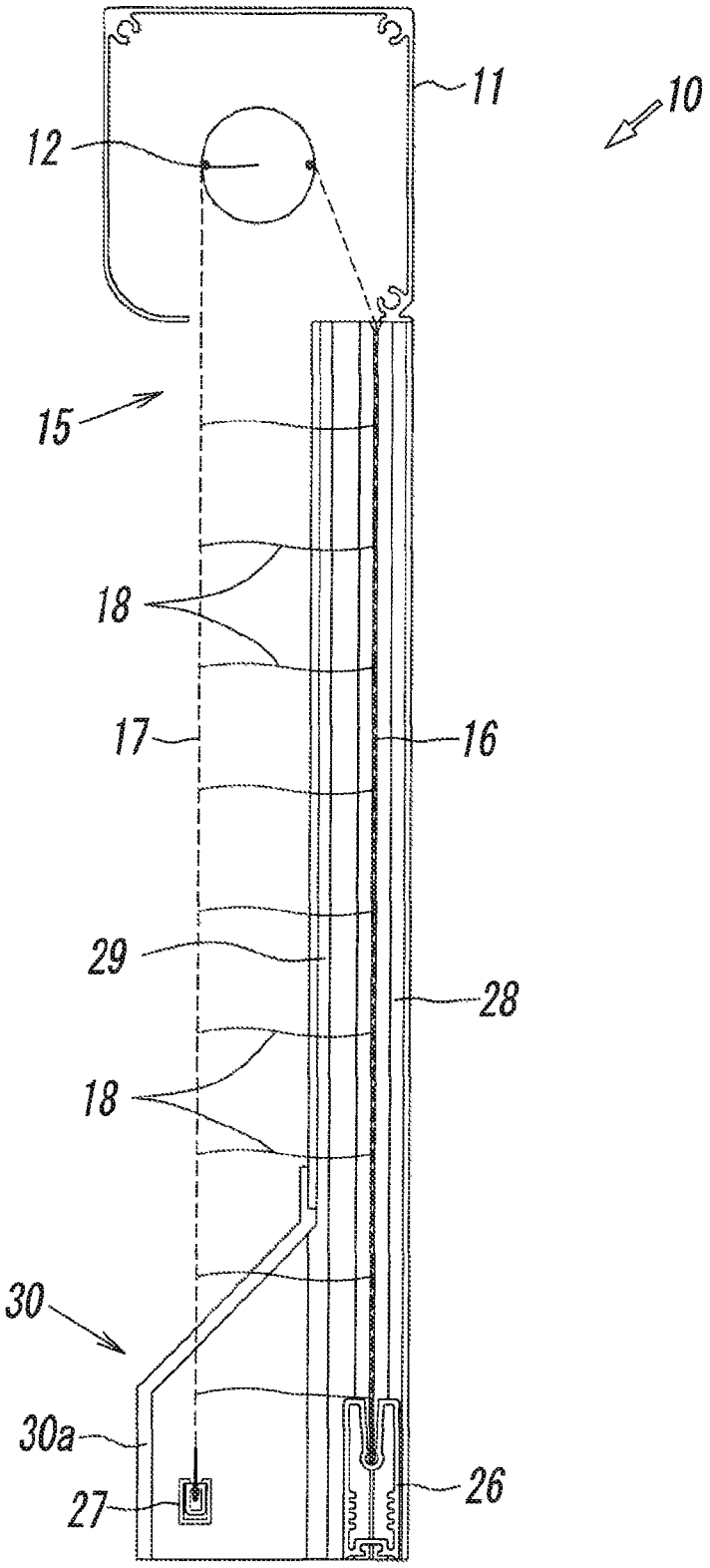
FIG. 9 is a schematic cross-sectional side view of a second embodiment in which lower portions of guide grooves configured to guide both ends of the bottom bar of a second screen is deformed.

FIG. 9 illustrates a second embodiment in which the second guiding mode is employed for the second screen 17 in the window screen of the above-described first embodiment. The above-described second guiding mode is specifically such that the guide grooves 29 on the above-described side frames 23 configured to guide the both ends of the second bottom bar 27 attached to the lower end of the above-described second screen 17 is provided in proximity to the guide grooves 28 for the first bottom bar 26 formed on the above-described side frames 23 in the same manner as the first embodiment. However, in the lower portion of the guide grooves 29, in a movable range of the second bottom bar 27 in a state in which the both screens 16, 17 are lowered to a position where the inclined posture of the above-described slats 18 can be adjusted, guide portion strips 27*a* (see FIG. 8) at the both ends of the second bottom bar 27 are released from the above-described guide grooves 29 by broadening the above-described guide grooves 29, and movement-restricting attachments 30 configured to restrict a free movement of the second bottom bar 27 in a direction away from the screen frame toward the indoor side from the lower portion of the side frames 23 of the screen frame from a state of engaging the above-described guide portion strips 27*a* and being suspended from the winding shaft 12 are added.

The above-described movement-restricting attachments 30 to be added in connection with the lower ends of the guide grooves 29 for the second bottom bar 27 provided on the side frames 23 are configured to significantly broaden the groove width of the lower portion of the above-described guide grooves 29, and is configured to restrict the bottom bar 27 from freely moving more than necessary in a direction away from the screen frame (the direction moving toward the indoor side) by wind or the like in a state illustrated in FIG. 9 in which the second bottom bar 27 is hung by the second screen 17 from the winding shaft 12. From this sense, the above-described movement-restricting attachments 30 release the guide portion strips 27*a* at the both ends of the second bottom bar 27 from being guided by the above-described guide grooves 29, but still constitute part of guide wall surfaces which are formed of free movement restricting walls 30*a* connected to the guide grooves walls on the second screen 17 side (the indoor side) of the guide grooves 29 and are configured to restrict the second bottom bar 27 from being significantly deviated from a state hung from the winding shaft 12 in a direction away from the screen frame.

With the addition of the movement-restricting attachments 30 as described above, as in the first guiding mode (FIG. 1 to FIG. 5) of the second screen 17, the second bottom bar 27 can be moved downward to some extent without guiding the above-described second bottom bar 27 to the lower end by the guide grooves 29 which are straight in the vertical direction and, at the terminals of the guide grooves 29, the second screen 17 can be suspended straightly from the winding position of the winding shaft 12, so that the partial sag in the lower portion of the second screen 17 like that generated in the first guiding mode of the second screen 17 is resolved, and the extreme movement of the second bottom bar due to wind or the like is suppressed by the above-described attachments 30. The above-described attachments 30 also have a function to prevent the second bottom bar 27 from moving freely in the direction away from the screen frame due to wind or the like and bringing harm to people.

Figure 10:
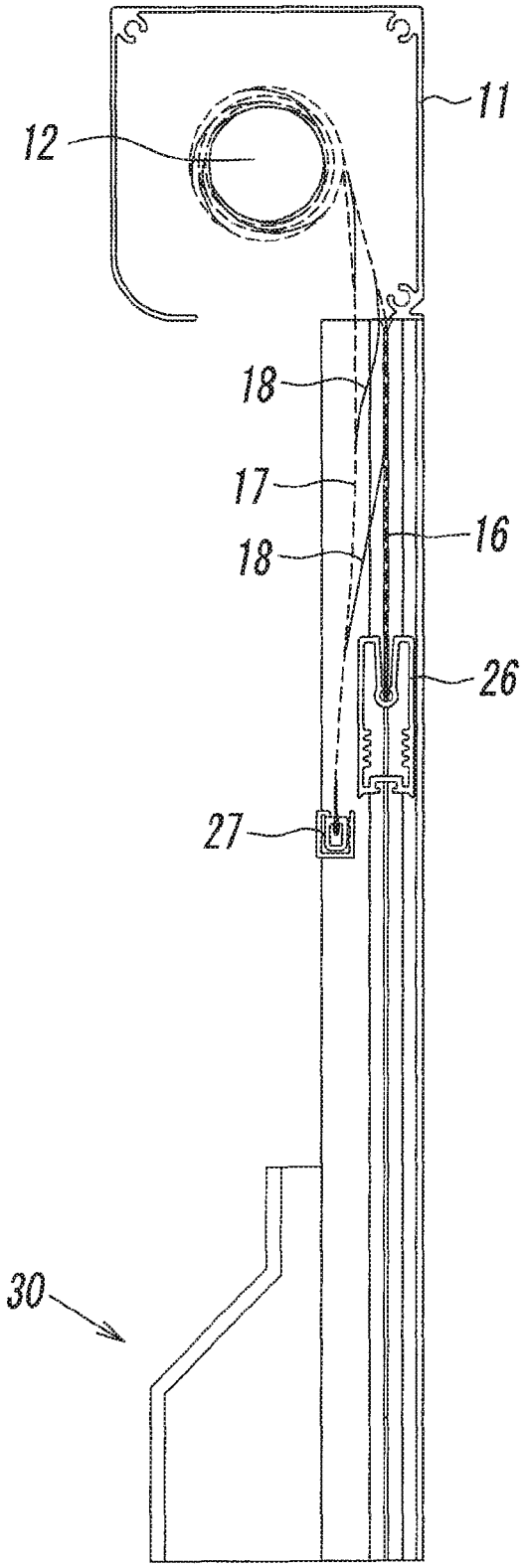
FIG. 10 is a schematic cross-sectional side view of a third embodiment in which the bottom bar of the second screen is configured not to be guided.

In addition, in a third embodiment of the present invention illustrated in FIG. 10, a third guiding mode regarding the vertical movement of the both ends of the second bottom bar 27 is employed and, specifically, a configuration in which the second bottom bar 27 attached to the lower end of the above-described second screen 17 is hung from the second screen 17 without guiding the vertical movement of the both ends thereof is employed. In the third guiding mode, the guide grooves configured to guide the vertical movement of the both ends of the second bottom bar 27 do not exist. However, since the second screen 17 and the second bottom bar 27 at the lower end are hung with respect to the first screen 16 by a number of the slats 18, as described above in conjunction with the above-described first mode, the second screen 17 is kept almost in parallel to the first screen 16 until either one of the bottom bars 26, 27 of the both screens 16, 17 reaches the lower frame 25 of the screen frame. In other words, since the guide grooves for the second bottom bar 27 do not exist, the same action as in the above-described first and second guiding modes is performed although there is a probability that the action of the second bottom bar 27 become slightly unstable.

In the third embodiment as well, as illustrated in FIG. 10, the movement-restricting attachments 30 configured to suppress the extreme movement of the second bottom bar 27 as in the second embodiment are preferably provided irrespective of the guide grooves 29 of the second bottom bar 27 in the second embodiment. However, in the case where there is no risk of the free movement of the second bottom bar 27 or in the case where simplification of the entire configuration is desired, the additional installation thereof may be omitted.

Figure 11:
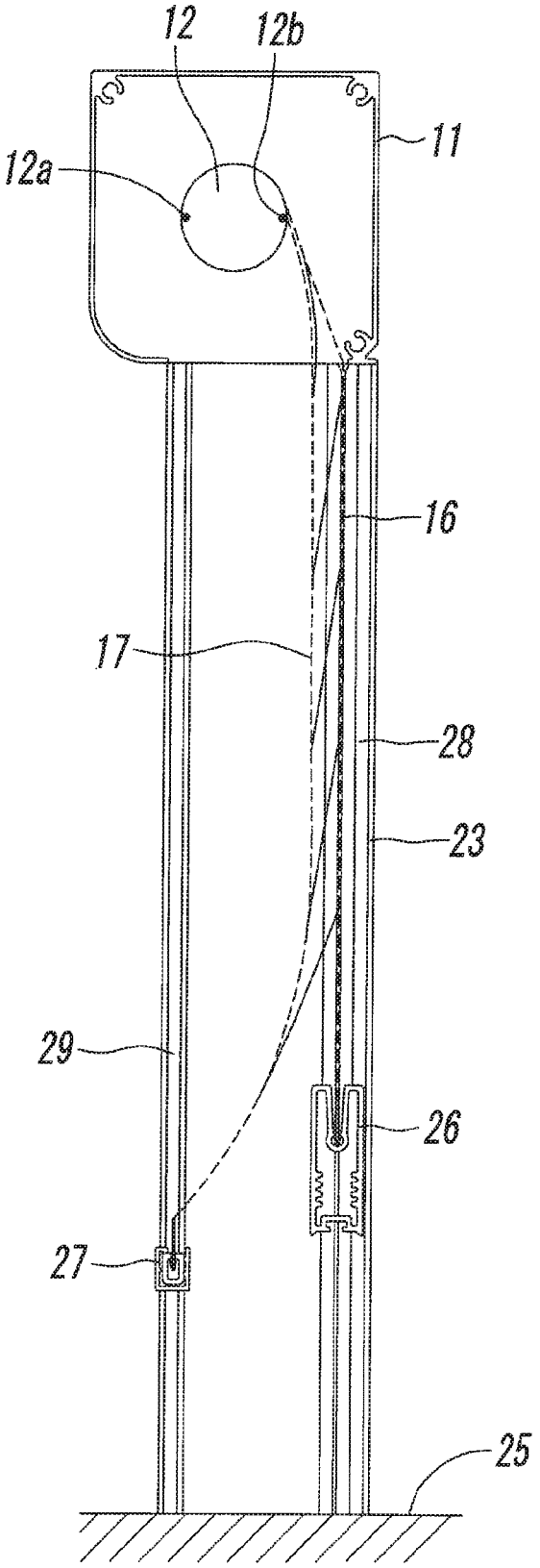
FIG. 11 is a schematic cross-sectional side view of a fourth embodiment in which the guide grooves configured to guide both ends of the bottom bar of the second screen are disposed at positions of suspension of the second screen when the slats reach a substantially horizontal state.

In a fourth embodiment of the present invention illustrated in FIG. 11, a fourth guiding mode regarding the vertical movement of the second bottom bar 27 is employed. In the fourth guiding mode, defining the position of the second screen 17 hung from the winding shaft 12 when the above-described second screen 17 is brought into a reverse winding state with respect to the winding shaft 12 after the both screens 16, 17 have been lowered by the rewinding rotation of the above-described winding shaft 12 and a deriving position of the second screen 17 from the winding shaft takes the farthest position from the suspending position of the first screen 16 as a maximum distance position, the guide grooves 29 configured to guide the vertical movement of the second bottom bar 27 are provided at positions away from the guide grooves 28 of the first bottom bar 26 on the side frames 23 by a certain length which is larger than that in the case of the first guiding mode, and the both ends of the second bottom bar 27 may be guided by the guide grooves 29.

FIG. 11 illustrates an example in which the guide grooves 29 configured to guide the vertical movement of the second bottom bar 27 are provided at the above-described maximum distance positions.

According to the fourth guiding mode, since the guide grooves 29 of the second bottom bar 27 are provided at positions away from the guide grooves 28 of the first bottom bar 26 by a required length, the both ends of the second bottom bar 27 are guided by the above-described guide grooves 29. However, since side ends of the second screen 17 are not guided, the second screen 17 is held almost in parallel to the first screen 16 until either one of the bottom bars 26, 27 of the both screens 16, 17 reaches the lower frame 25 of the screen frame as described above, and, when the reverse winding of the second screen 17 with respect to the winding shaft 12 is started, the second bottom bar 27 is guided by the above-described guide grooves 29. Therefore, the second screen 17 is extended in a tensed manner in a state of elevating from the second bottom bar 27 guided by the guide grooves 29 and, when the guide grooves 29 are at the above-described maximum distance positions as illustrated, is extended in a tensed manner substantially vertically upward from the second bottom bar 27, so that the slats 18 are inclined in accordance with the position of the upward movement of the second bottom bar 27. Therefore, as illustrated in FIG. 4 and FIG. 5, no sag as if being pulled toward the first screen 16 side is generated on the lower portion of the second screen 17.

Subsequently, a desirable attachment position of the winding shaft 12 in the winding box 11 described above will be described. As described above, in the case where the screen unit in which both ends of a number of the slats are attached between the first screen and the second screen is wound around the winding shaft 12 in a state in which the both screens overlap with each other, it is desired that the distance between the first and second screens 16, 17 are kept by the winding shaft 12 at a distance which is assumed when the slats are tilted in the case where the both screens are extended in the screen frame entirely in a tensed manner and the slats 18 are tilted. Therefore, it is suitable to determine the diameter of the winding shaft 12 to be substantially the same as the distance between the both screens when the above-described slats are tilted. However, if the diameter of the winding shaft 12 is set in this manner, the wound diameter of the first and second screens 16, 17 when being wound on the winding shaft 12 in an overlapped manner is increased, so that the capacity of the winding box 11 needs to be increased correspondingly.

However, it is not desirable to increase the size of the winding box 11 more than necessary, and hence the problem is solved by a configuration described below in a fifth embodiment illustrated in FIG. 12.

In other words, in a state in which the first and second screens 16, 17 are wound around the above-described winding shaft 12 in an overlapped manner, setting the supporting position of the winding shaft 12 in the winding box 11 so that the deriving position of the engaging strips 21 (see FIG. 8) attached along the side end portions of the wound first screen 16 from the surface of the winding screen comes above the guide rails 24 for the engaging strips 21 on the side frames 23 makes introduction of the engaging strips 21 into the guide rails 24 smoothly when starting rewinding, and in a state in which the second screen 17 is suspended from a peripheral side surface on the opposite side from a deriving side of the first screen 16 in the winding shaft 12 by the rewinding of the both screens 16, 17 from the above-described winding shaft 12 (see FIG. 4 and FIG. 5), setting the supporting position of the winding shaft 12 into the above-described winding box 11 so that the suspending position at which the slats 18 attached between the both screens 16, 17 become the longest with respect to the extending position of the above-described first screen 16 in a tensed manner is desired for smoothening the tilting movement of the slats 18.

Figure 12:
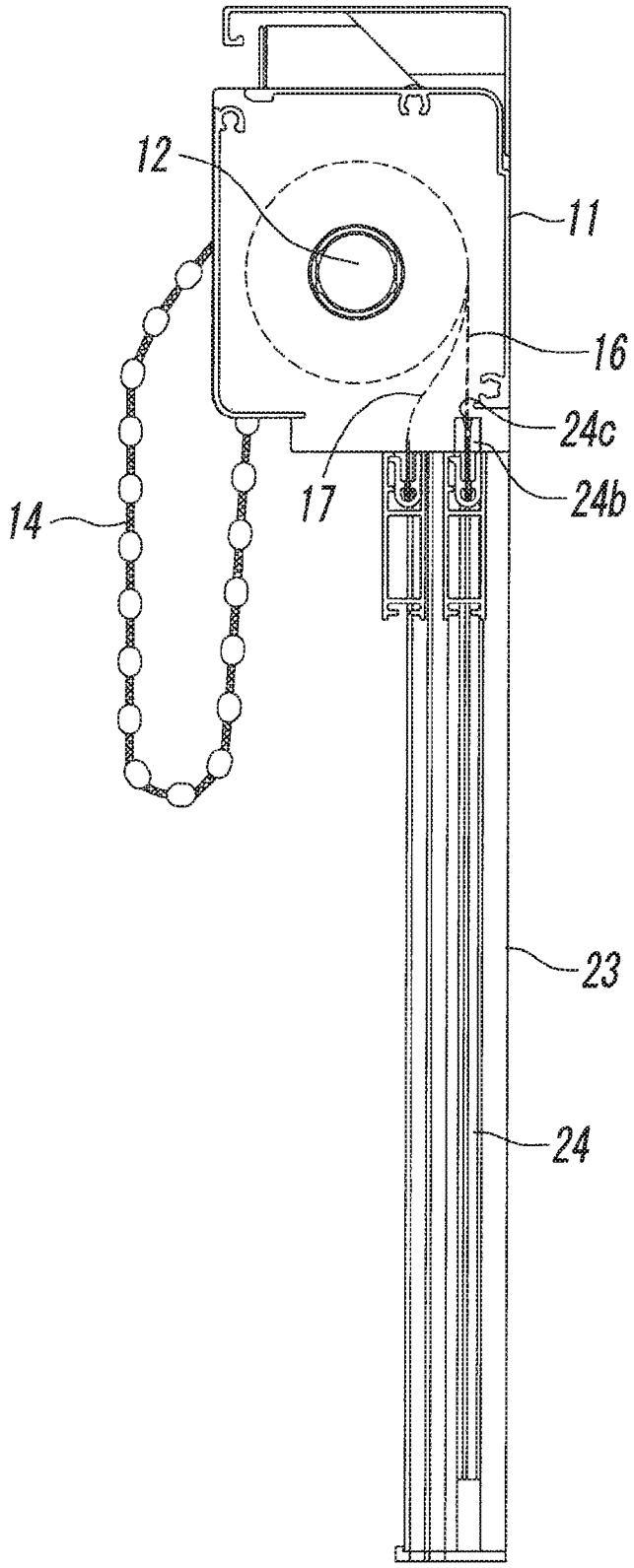
FIG. 12 is a schematic cross-sectional side view of a fifth embodiment in which a desirable attachment position of the winding shaft in a winding box.

As is apparent from FIG. 12, the embodiment regarding the supporting position of the winding shaft 12 is effective for reducing the diameter of the winding shaft 12 to reduce the size of the winding box and, in addition, since the deriving position of the engaging strips 21 attached to the side end portions of the wound first screen 16 from a surface of the winding screen is located above the guide rails 24 for the engaging strips 21 on the side frame 23, an angle at which the engaging strips 21 of the first screen 16 which is rewound from the winding shaft 12 is introduced into the guide rails 24 is increased with the progress of the above-described rewinding. However, with the provision of the inclined guide surfaces 24*c* which introduces the engaging strips 21 at upper ends of the guide rails 24 or guide rail extended portions 24*b* connected thereto, guiding for introducing the engaging strips 21 with respect to the guide rails 24 is achieved smoothly.

With the above-described configuration, the second screen 17 is suspended at a position apart from the winding shaft 12 by a distance corresponding to the winding of the screen unit 15. Therefore, the wound surface of the screen unit 15 wound around the winding shaft 12 may be arranged in the proximity to the outdoor side surface of the winding box 11, which is an extending position of the first screen 16 in a tensed manner, as much as possible and, in addition, as is understood from FIG. 15, when the both screens 16, 17 are extended in a tensed manner, the second screen 17 can be suspended from the peripheral side surface, which is the opposite from the deriving side of the first screen 16 on the winding shaft 12, and the screen unit 15 in the winding state may be accommodated in a storage space having a required size, which may be formed on the indoor side of the winding box 11 as illustrated in FIG. 12. Consequently, the shaft diameter of the winding shaft 12 is reduced, so that the wound diameter when the first and second screens 16, 17 are wound in an overlapped manner may be reduced.

Figure 13:
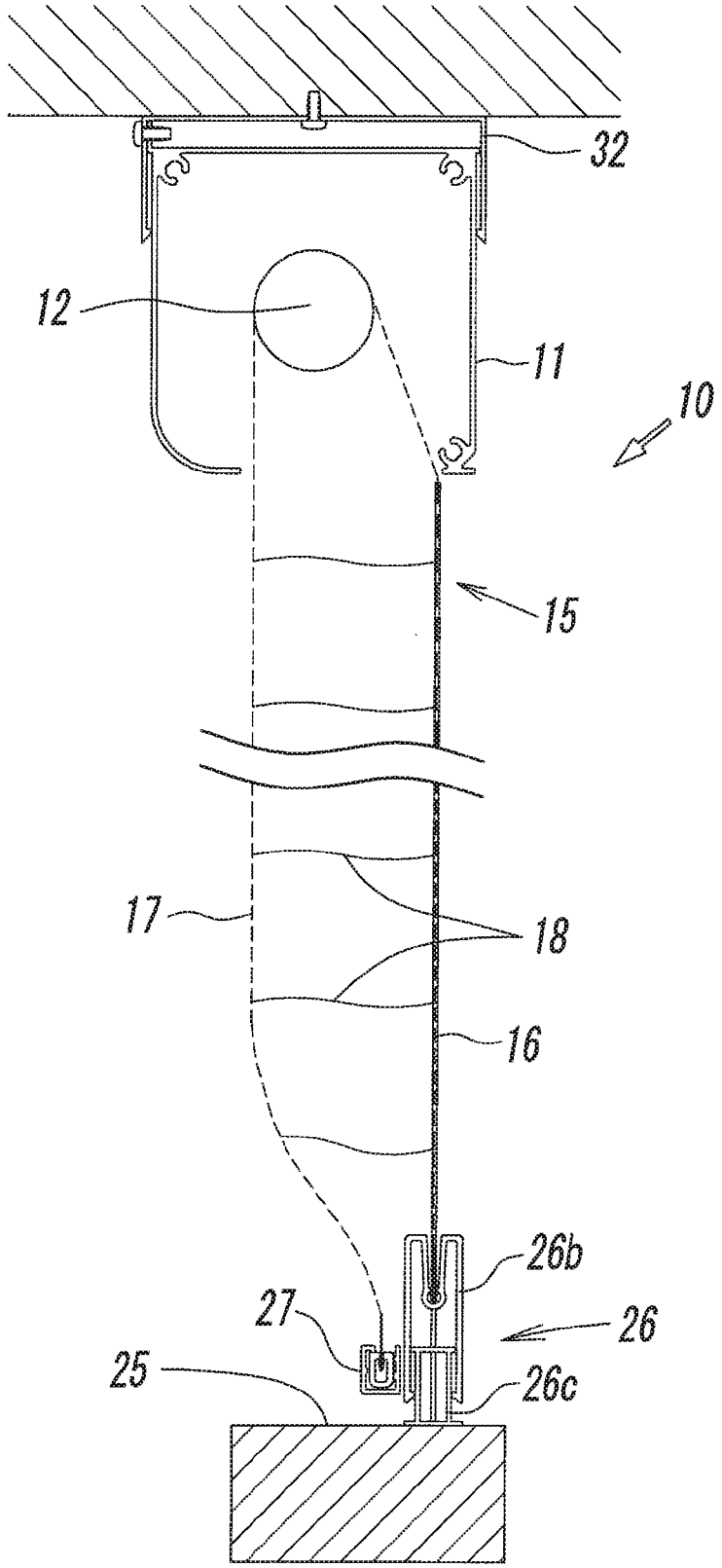
FIG. 13 is a schematic cross-sectional side view of a sixth embodiment in which drawing of the side frame is omitted for explaining a mode of dimensional adjustment when installing the winding box and the bottom bar of a first screen (during fine adjustment).
Figure 14:
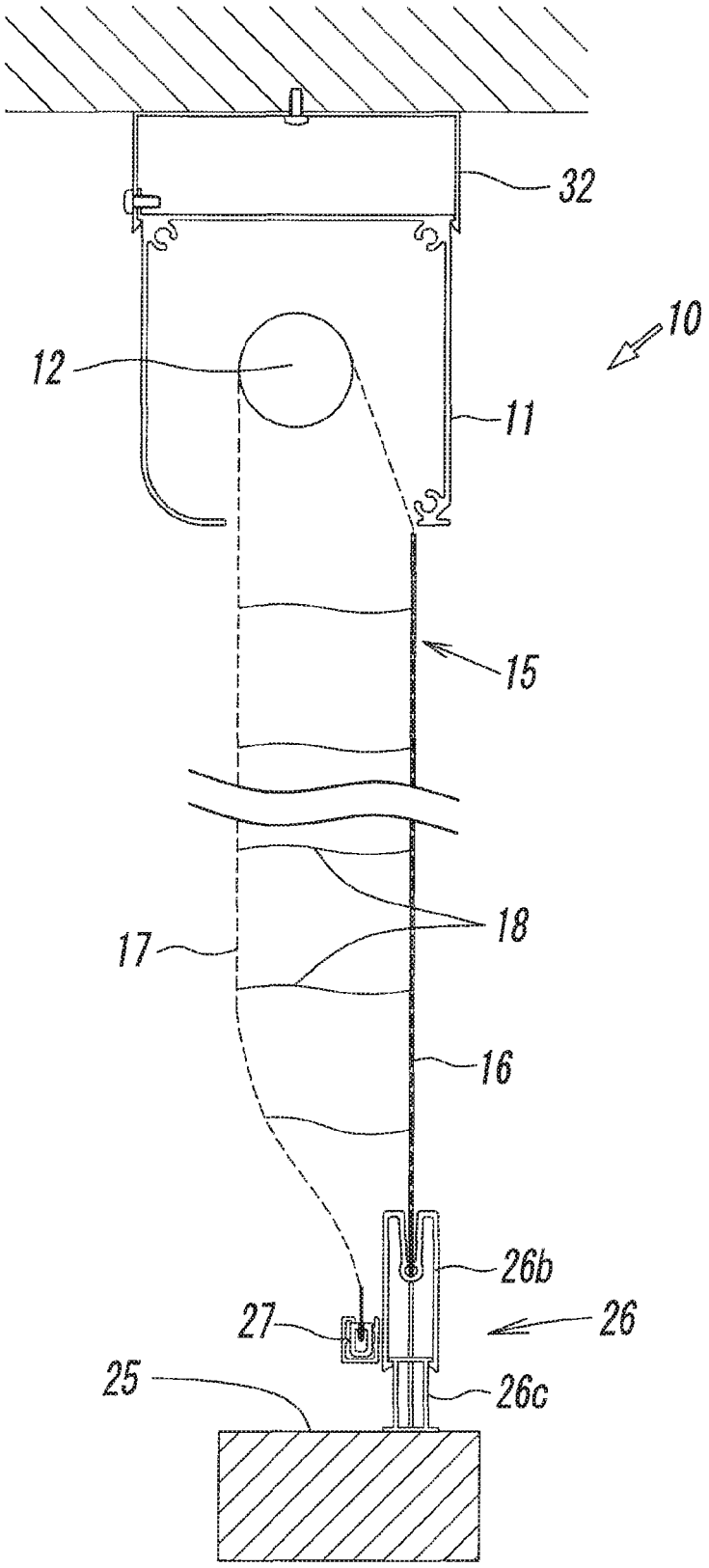
FIG. 14 is a schematic cross-sectional side view for explaining a mode of a dimensional adjustment (during adjustment of a large dimension) in the same sixth embodiment.

In the case where the lengths of the first and second screens 16, 17 is slightly shorter than the length of the building opening in the vertical direction in which the window screen is to be installed or in the case where a gap is generated between the bottom bar and the lower frame 25 of the screen frame for any reason when the first bottom bar 26 at the lower end of the first screen 16 is lowered, a sixth embodiment illustrated in FIG. 13 and FIG. 14 is effective for eliminating the above-described gap easily without replacing the screen unit 15 with a member having a required length. Specifically, the first bottom bar 26 to be attached to the lower end of the above-described first screen 16 may be configured in such a manner that an auxiliary beam 26*c* for adjusting the dimensions is inserted so as to be freely movable in and out from the lower portion of a bottom bar body 26*b*.

The configurations and the mechanisms of the bottom bar body 26*b* and the auxiliary beam 26*c* will be specifically described. If the length of the portion of installation of the building opening in the vertical direction is slightly larger than the length suitable for the installation of the window screen 10 in the case where the above-described first and second screens 16, 17 are manufactured to have predetermined lengths and are installed in an existing building opening, as illustrated in FIG. 13 and FIG. 14, the bottom bar 26 to be attached to the lower end of the first screen 16 may be configured in such a manner that the auxiliary beam 26*c* for adjusting the dimensions is inserted into the bottom bar body 26*b* so as to be freely movable in and out from a lower portion thereof. In this case, the above-described auxiliary beam 26*c* may be formed so as to move in and out manually by a required length. However, the auxiliary beam 26*c* may be configured to be retracted into the bottom bar body 26*b* when the auxiliary beam 26*c* projects from the bottom bar body 26*b* under its own weight and the auxiliary beam 26*c* comes into contact with the lower frame 25 of the screen frame and hence a gravitational force of the bottom bar body 26*b* acts thereon.

Since the above-described auxiliary beam 26*c* is inserted into the bottom bar body 26*b* so as to be freely movable in and out from the lower portion thereof, as illustrated in FIG. 13, when the gap between the bottom bar 26 and the lower frame 25 is small, the amount of projection of the auxiliary beam 26*c* is reduced when the gap between the bottom bar 26 and the lower frame 25 is large as illustrated in FIG. 14, the gap having given certain sizes of a constant range may be accommodated by increasing the amount of projection of the auxiliary beam 26*c*, whereby generation of an unsightly gap may be prevented.

The second bottom bar 29 provided at the lower end of the second screen 17 may be provided with the same configuration as the above-described first bottom bar 26 if necessary.

Furthermore, as illustrated in FIG. 13 and FIG. 14 described above, the winding box 11 may be fixed to a bracket 32 with a screw (not illustrated) or the like by using the bracket 32 having a given height for hiding the gap when attaching the winding box 11, and this may be performed simultaneously with a method of adding the above-described auxiliary beam 26*c*.

As described above, in the window screen with a blind function configured to use the screen unit 15 including the slats 18 attached between the first and second screens 16, 17 and tilt the above-described slats, if insects or the like enter the winding box 11 from the opening of the winding box 11 from which the first and second screens 16, 17 are derived, the insects or the like often enter the indoor side or enter between the first and second screens from the side ends of the screen unit 15 in the winding box 11, and cannot escape therefrom. Since these insects are visible through the second screen, the appearance becomes quite bad and, in addition, if dead bodies of the insects are accumulated therein, the window screen cannot be used any longer.

However, as illustrated as a seventh embodiment in FIG. 15, by disposing a simple gap sealing member 35 at a desired position of the winding box 11 described above, entry of insects between the first and second screens 16, 17 may be suppressed.

In the window screen of the seventh embodiment, at least the above-described first screen 16 is formed of an insect preventing net, and, at an opening 11*a* at a lower portion of the winding box 11 in which the above-described winding shaft 12 is rotatably accommodated and from which the first and second screens 16, 17 are derived, the gap sealing member 35 which comes in proximity to or in contact with the first screen 16 derived from the winding shaft 12 to prevent passage of insects therebetween is disposed at an opening wall 11*b* of the winding box 11 opposing the first screen 16 within a range in which the engaging strips 21 provided at side ends of the first screen 16 engage the guide rail 24 so as to be freely slidable.

As the above-described gap sealing member 35, a sealing member for a gap having soft long fibers generally referred to as mohair planted therein, a light-shielding soft foamed synthetic resin member, or a flexible rubber-like thin strip may be used.

In the window screen using the above-described screen unit 15, a point which is required to prevent entry of insects is the opening 11*a* at the lower portion of the above-described winding box 11, specifically, a gap generated between the opening wall 11*b* of the opening 11*a* on the outdoor side and the first screen 16 derived from the winding shaft 12. Therefore, in the opening 11*a* from which the first and second screens 16, 17 of the winding box 11 are derived, as illustrated in FIG. 15, a sag 16*a* is generated at an upper portion of the first screen 16 whereof the first bottom bar 26 has already reached the lower frame 25 bar 26 when the slats 18 are moved upward on the side coupled to the second screen 17 by the reverse winding of the second screen 17 with respect to the winding shaft 12. Even though the gap sealing member 35 provided on the above-described opening wall 11*b* is brought into contact with the first screen 16 at the portion where the sag has generated, the effect of suppressing the entry of insects is not always expected.

Therefore, in order to dispose the above-described gap sealing member 35 in the above-described first screen 16 while avoiding the portion where the sag 16*a* may be generated, the upper ends of the guide rails 24 for the engaging strips 21 attached to the side end portions of the first screen 16 are extended into the introducing portion into the winding box 11 of the first screen 16, or the guide rail extended portions 24*b* are provided continuously from the upper ends of the guide rails 24 in the side frames 23 so as to guide the engaging strips 21 also in the winding box 11, so that a range where the engaging strips 21 at the side ends of the first screen 16 engage the guide rails 24 so as to be freely slidable are extended, and the gap sealing member 35 arranged so as to face the first screen 16, which is kept in a tensed state by suppressing generation of the above-described sag 16*a* by being supported at the both ends of the first screen thereby, and configured to suppress entry of insects by being positioned in proximity to or in contact with the first screen is disposed on the opening wall 11*b* of the winding box 11. Therefore, entry of insects between the first and second screens 16, 17 or entry of insects from the outside into the indoor side may be stably suppressed.

As described above, in the window screen with a blind function configured to use the screen unit 15 including the slats 18 having a light-shielding property attached between the first and second screens 16, 17, the distance between the first and second screens 16, 17 is increased significantly in comparison with the case of a single screen for allowing the tilting movement of the slats 18. Therefore, the above-described opening 11*a* at the lower surface of the winding box 11 needs to be increased in size in a direction of the distance between the first and second screens, and leakage of outdoor light into the indoor side during the night through the opening 11*a* or the like is desired to be suppressed.

In addition, as is understood from the description given above with reference to FIG. 15, at the opening 11*a* on the lower surface of the winding box 11, if the rewinding of the both screens 16, 17 is performed by the winding shaft 12 carelessly, the sag 16*a* is generated in an upper portion of the first screen 16 by a reverse winding of the second screen 17 with respect to the winding shaft 12. In the portion where the sag is generated, a light leaking portion 37 from the outside as illustrated in FIG. 17 may be generated due to the deformation or the like of the slats 18.

Figure 17:
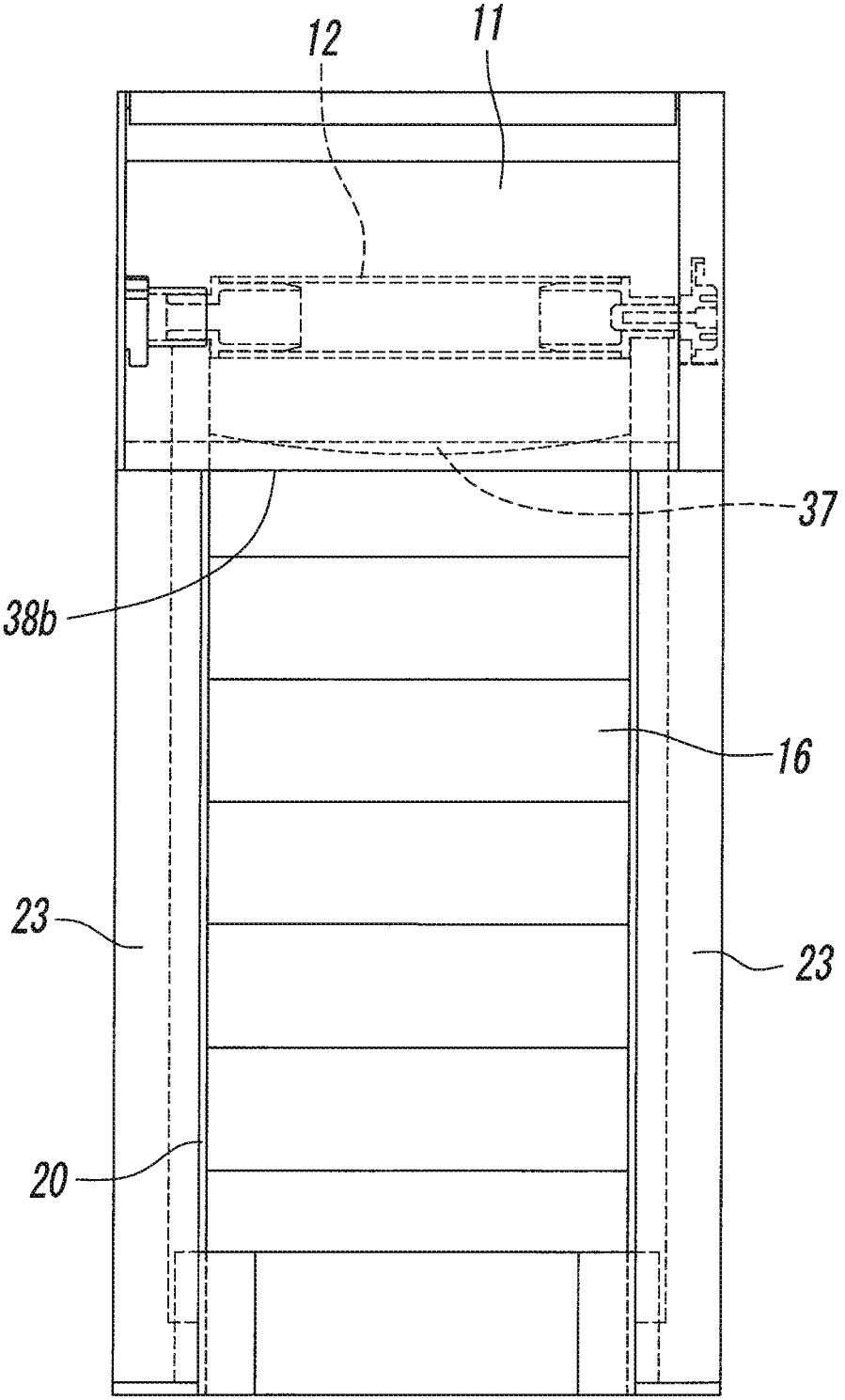
FIG. 17 is a back view of the same eighth embodiment.

An eighth embodiment illustrated in FIG. 16 and FIG. 17 is configured to perform the above-described light-shielding further reliably. In the eighth embodiment, the above-described slats 18 are formed of sheets having a light-shielding property, and are arrayed so as not to allow light leakage from a gap between the adjacent slats 18, and the supporting bands 20 for a number of the engaging strips 21 attached along the left and right side ends of the first screen 16 are formed of a light-shielding material or, alternatively, light leakage along the left and right side ends of the first screen 16 is blocked by a light-shielding frame (not illustrated) added separately along the side frames 23 of the above-described screen frame and, in addition, a leakage preventing member 38*a* configured to come into contact with the first screen derived from the winding shaft 12 to suppress light leakage therebetween is disposed at the opening wall 11*b* of the opening 11*a* opposing the first screen 16 on the lower portion of the winding box 11 in which the above-described winding shaft 12 is rotatably accommodated. Examples of the leakage preventing member 38*a* may include a material exemplified above as the gap sealing member 35 configured to prevent entry of insects.

Apart from the above-described light leakage preventing member 38*a* described above, a light leakage preventing member 38*b* including a light-shielding wall suspending downward is provided on the box wall of the outdoor side surface and the left and right side end surfaces of the opening 11*a* at the lower surface of the winding box 11 as illustrated in FIG. 16 and FIG. 17 is provided, whereby, or in association with the leakage preventing member 38*a*, the light leakage as described above may be effectively suppressed.

In the above-described window screen with a blind function described above, the opening-and-closing operating member including the operating cord 14 or the like configured to achieve the winding and rewinding rotation of the first and second screens 16, 17 by rotating the winding shaft 12 is provided, and in the case where the screen unit 15 is operated by using the opening-and-closing operating member, it is relatively difficult to stop the screen unit at a required position. In particular, in the window screen provided with the above-described screen unit 15, since one of the bottom bars 26, 27 finally comes into contact with the winding box 11 when winding the first and second screens 16, 17, there are comparatively little problems. However, if the excessive rotation occurs during the rewinding rotation of the above-described winding shaft 12, the both screens 16, 17 might be wound reversely on the winding shaft 12 after the first bottom bar 26 has come into contact with the lower frame 25 of the screen frame. Therefore, it is effective for preventing damage of part of the screen unit 15 to set a limit of the upward movement of the slats 18 by the second screen 17 and disable the operation of the above-described opening-and-closing operating member which exceeds the limit.

Therefore, in the above-described window screen, as illustrated in FIG. 15, FIG. 16, and so forth, the opening-and-closing operating member including the continuous bead-type operating cord 14 configured to achieve the winding and rewinding rotation of the first and second screens by rotating the winding shaft is provided at the shaft end of the above-described winding shaft 12, and the opening-and-closing operating member is provided with a stopper 40 configured to stop the rotation of the winding shaft in a state of causing no damage before the first bottom bar 26 moves away from the lower frame 25 after having come into contact with the lower frame of the screen frame by an excessive rotation during the rewinding rotation of the above-described winding shaft 12, whereby damage of the screen unit 15 is prevented. As the above-described stopper 40, having a configuration in which a disc-shaped member configured to be locked with an opening edge of an introduction port to the winding box 11 is added on part of the above-described operating cord 14 is illustrated. However, the stopper 40 having a suitable configuration may be added to the opening-and-closing operating member having various known configurations.

Figure 18:
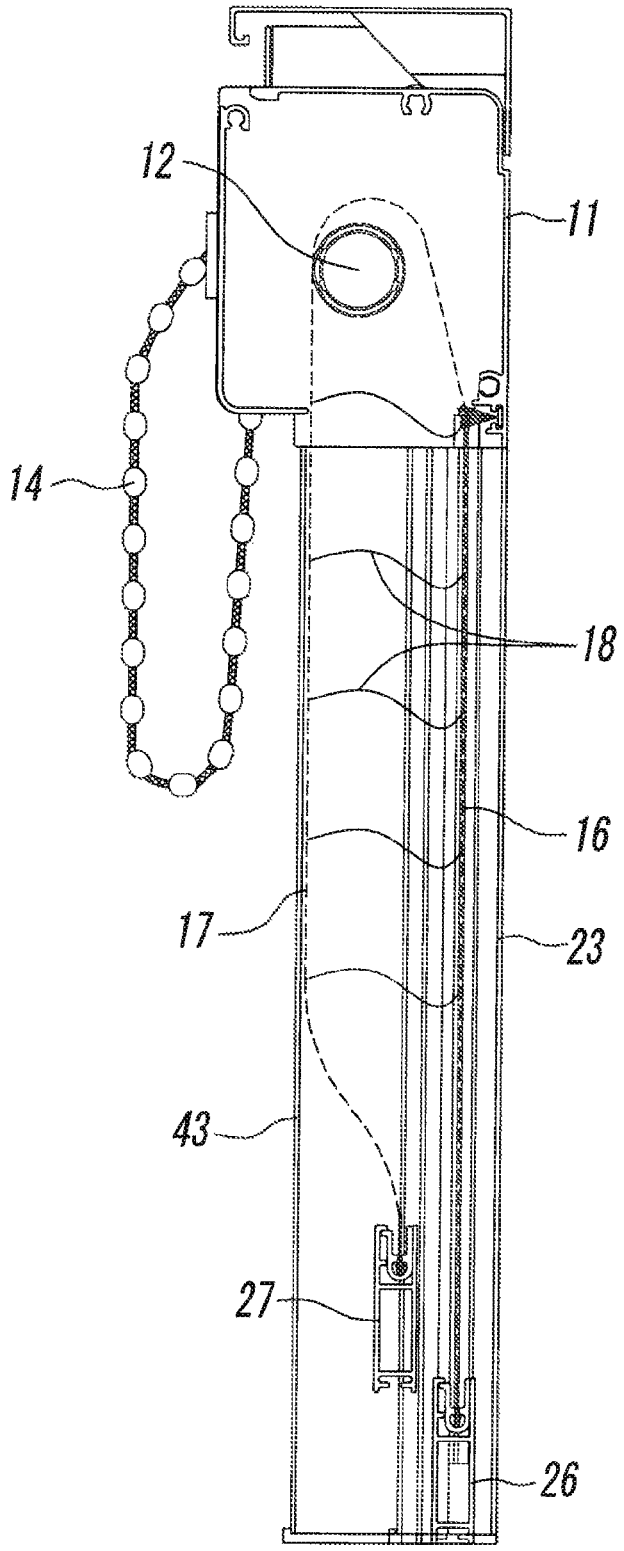
FIG. 18 is a schematic cross-sectional side view of a ninth embodiment provided with a cover for protection and dust-proofing of the screen unit.
Figure 19:
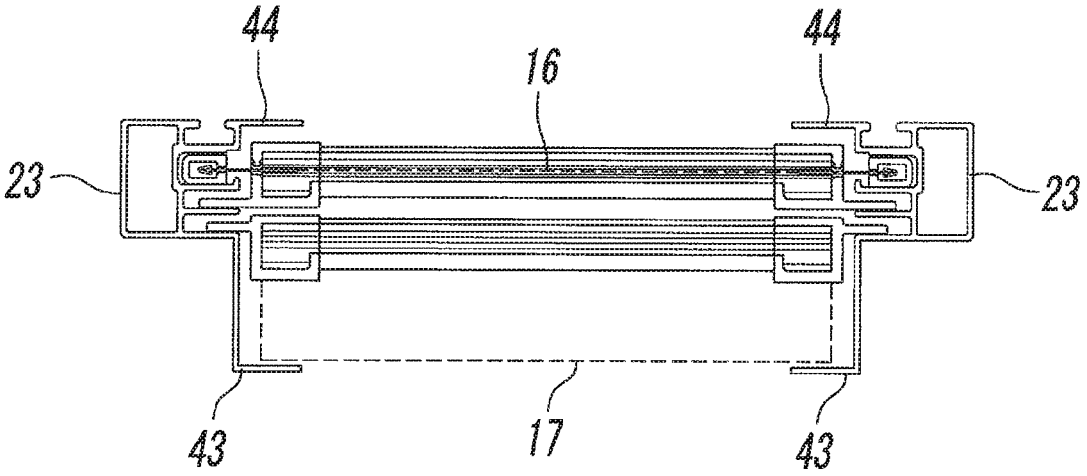
FIG. 19 is a schematic horizontal cross-sectional view of the same ninth embodiment.
Figure 20:
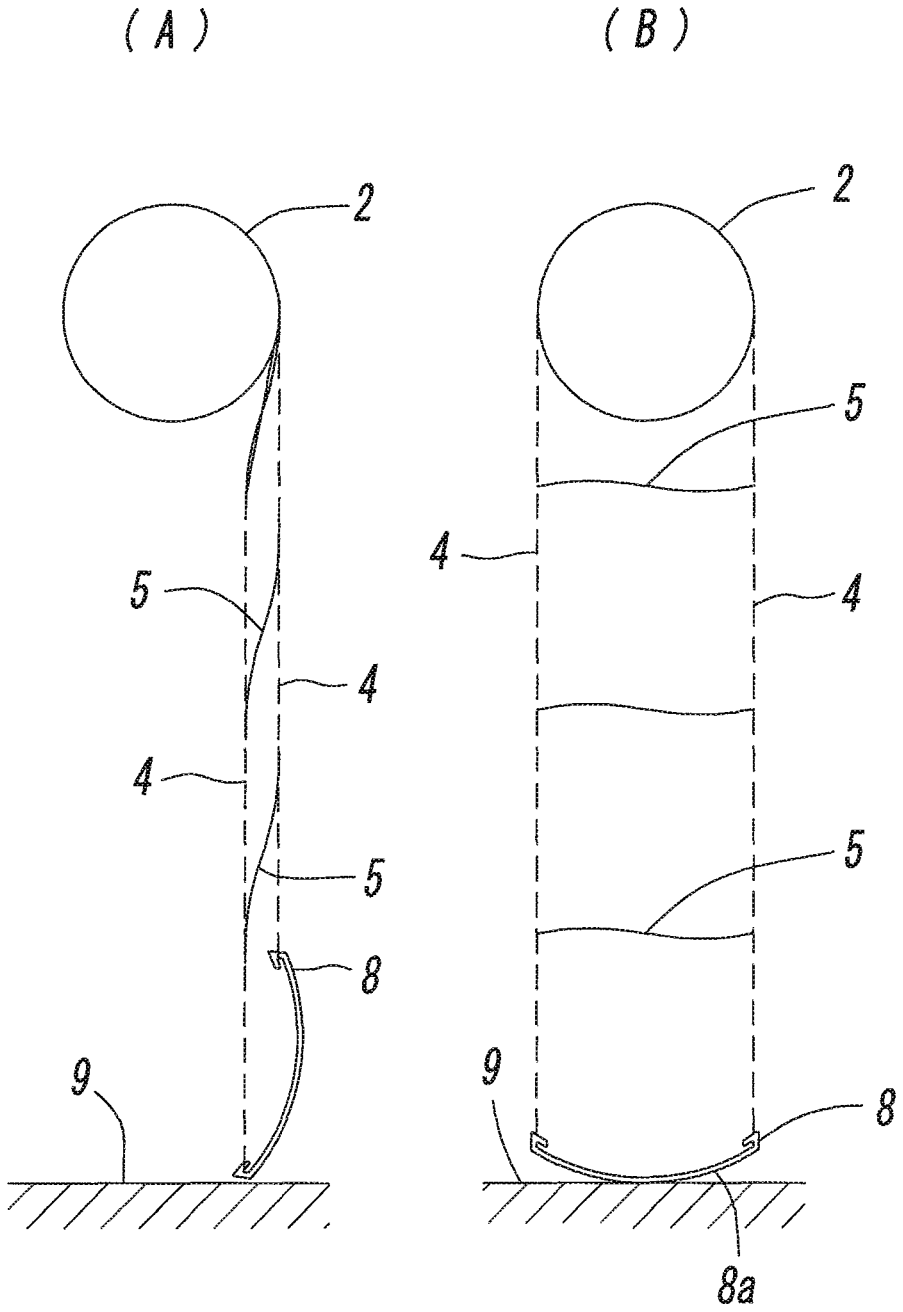
FIGS. 20(A) and (B) are schematic explanatory drawings of trial models in a course of achievement of the present invention.

Although the description has been given in conjunction with the seventh embodiment, the above-described window screen includes a cylindrical space surrounded by the first and second screens 16, 17 and the slats 18, and prevention of entry of insects or foreign substances into this space needs to be sufficiently considered. In order to address this problem, the window screen of a ninth embodiment illustrated in FIG. 18 and FIG. 19, covers 43 intended for protection and dust proofing of the above-described screen unit 15 are added to the left and right side frames 23 of the screen frame over ranges of the side frames that the screen unit 15 can be extended in a tensed manner in the vertical direction so as to cover left and right end surfaces between the both screens in a state in which the distance between the first screen 16 and the second screen 17 is the largest and the front surface side of the left and right ends of the second screen 17. The cover 43 may be integrated with the side frames 23 of the screen frame as is understood from FIG. 19 and, for example, may be molded as a die member having a certain cross-section and being formed of a synthetic resin or the like, or the above-described cover 43 and the auxiliary cover 44 on the outdoor side and the side frames 23 may be separately formed so as to be fixed to the side frames 23 with screws or the like.

The covers 43 in this configuration are effective not only for preventing the entry of insects and foreign substances into the above-described cylindrical space, but also for suppressing damage of the both left and right side ends of the screen unit 15 which may be caused by infants or pets.

Here, configurations and mechanisms of portions which substantially have no difference from the window screen of the first embodiment in the drawings in conjunction with the window screens with a blind function from the above-described second embodiment onward are the same as those of the window screen with a blind function described in conjunction with the first embodiment. Therefore, the same reference numerals are allocated to the same or corresponding portions in the drawings from the second embodiment onward, and descriptions are omitted.

The invention claimed is:

1. A window screen with a blind function comprising: a screen unit, the screen unit including:

a translucent first screen configured to be wound upward by a winding shaft;

a translucent second screen configured to be wound by the winding shaft together with the first screen in an overlapped manner; and a number of slats for dimming or light-shielding having a constant width and coupled between the first screen and the second screen, the slats being coupled at first and second ends thereof to both the first and second screens at regular intervals so as to be freely tiltable, and having flexibility so as to be capable of being wound by the winding shaft together with the first and second screens, wherein in the screen unit, one end of each of the first and second screens is attached to a peripheral surface of the winding shaft so as to allow the first and second screens to be wound in an overlapped manner, the first screen includes a number of engaging strips attached thereto along left and right side end portions, the engaging strips being engaged in slits of a guide rail on each of two side frames of a screen frame so as to be freely slidable, the first and second screens are provided with first and second bottom bars attached individually to lower ends thereof, at least the first bottom bar attached to the lower end of the first screen is disposed in first guide grooves of the side frames to guide a vertical movement of both ends thereof, and the first and second screens have length set so that either one of the bottom bars at the lower ends thereof comes into contact with a lower frame of the screen frame in an arbitrary inclined orientation that the slats can have in a state in which both the first and second screens are extended in the screen frame in a tensed manner.

2. The window screen with a blind function according to claim 1, wherein the first and second screens are attached to the winding shaft so as to have a dimensional relationship so that a downward movement of both the first and second screens by an unwinding rotation of the winding shaft brings the first and second bottom bars to the lower frame of the screen frame simultaneously, or the first bottom bar does not reach the lower frame before the second bottom bar, and then brings the second screen to a reverse winding state with respect to the winding shaft to move the second screen upward with respect to the first screen, whereby the respective slats are formed so as to be capable of having an inclined orientation moving upward and downward on a second screen side in a state in which either one of the first and second bottom bars is in contact with the lower frame.

3. The window screen with a blind function according to claim 2, wherein both the first and second screens are attached to the winding shaft so as to have a dimensional relationship such that a number of the slats coupled respectively to both the first and second screens suspend the second screen with respect to the first screen when both the first and second screens move downward by the unwinding rotation of the winding shaft, whereby the second screen and the second bottom bar at the lower end thereof are supported by the first screen and suspend therefrom.

4. The window screen with a blind function according to claim 3, wherein the slats have coupling margins having a certain width in a width direction on both first and second ends thereof for coupling the first and second screens, and the screen unit is formed in such a manner that when the slats are disposed between the first and second screens so as to overlap with each other and form a planar shape, each slat is coupled to the second screen at a position where a coupling margin of the slat with respect to the second screen overlaps with a coupling margin on one side of an adjacent slat coupled to the first screen.

5. The window screen with a blind function according to claim 4, wherein the vertical the second bottom bar includes first and second ends, and movement of both first and second ends of the second bottom bar attached to the lower end of the second screen is guided by second guide grooves for the second bottom bar provided in proximity to the first guide grooves for the first bottom bar formed on the side frames, both first and second guide grooves formed in proximity in a range in which the first and second bottom bars do not come into contact with each other.

6. The window screen with a blind function according to claim 4, wherein the second bottom bar includes first and second ends, and second guide grooves on the side frames configured to guide the vertical movement of both first and second ends of the second bottom bar attached to the lower end of the second screen are provided in proximity to the first guide grooves for the first bottom bar formed on the side frames, in a lower portion of the second guide grooves, both first and second ends of the second bottom bar are released from the second guide grooves in a range in which both first and second screens are lowered to a range in which an inclined orientation of the slats can be adjusted, and further comprising a movement-restricting attachment added to a lower portion of the screen frame and configured to restrict free movement of the second bottom bar in a direction away from the screen frame when suspended from the winding shaft.

7. The window screen with a blind function according to claim 4, wherein the second bottom bar includes first and second ends, and the second bottom bar attached to the lower end of the second screen is suspended from the second screen without guiding the vertical movement of both ends thereof.

8. The window screen with a blind function according to claim 4, wherein a position of the second screen hung from the winding shaft when the second screen is brought into a reverse winding state with respect to the winding shaft after both screens first and second have been lowered by the unwinding rotation of the winding shaft and a deriving position of the second screen from the winding shaft takes a farthest position from the first screen is defined as the maximum distance position, and the second bottom bar includes first and second ends, and second guide grooves configured to guide the vertical movement of the second bottom bar are provided at the positions apart from the first guide grooves for the first bottom bar formed on the side frames by a certain length so that both first and second ends of the second bottom bar are guided by the second guide grooves.

9. The window screen with a blind function according to claim 4, wherein in a state in which the first and second screens are wound around the winding shaft in an overlapped manner, a supporting position of the winding shaft in a winding box configured to accommodate the winding shaft is set so that a deriving position of engaging strips attached along the side end portions of the wound first screen from a surface of the winding screen is located above the guide rails for engaging strips on the side frames, and in a state in which the second screen is suspended from a peripheral side surface on the opposite side from a deriving side of the first screen in the winding shaft by unwinding both first and second screens from the winding shaft, the supporting position of the winding shaft into the winding box is set so that a suspending position at which the slats attached between both first and second screens becomes the longest with respect to an extending position of the first screen in a tensed manner.

10. The window screen with a blind function according to claim 1, wherein the first bottom bar to be attached to the lower end of the first screen is configured in such a manner that an auxiliary beam for adjusting the dimensions is provided so as to be freely movable in and out from a lower portion of a bottom bar body.

11. The window screen with a blind function according to claim 1, wherein at least the first screen is formed of an insect preventing net, and further comprising a gap sealing member configured to come into proximity to or contact with the first screen derived from the winding shaft and suppress passage of insects therebetween, the gap sealing member disposed at an opening edge of the winding box opposite the first screen within a range in which engaging strips at side ends of the first screen engage the guide rails so as to be freely slidable at an opening at a lower portion of the winding box in which the winding shaft is rotatably accommodated from which the first and second screens are derived.

12. The window screen with a blind function according to claim 1, wherein the slats are formed of a light-shielding sheet and are arrayed so as not to allow light leakage from a gap between adjacent slats, and further comprising a light-shielding frame provided on a supporting band for a number of engaging strips to be attached along the left and right side ends of the first screen or the side frames of the screen frames, the frame blocking light leakage along the left and right side end portions of the first screen, and a leakage preventing member configured to come in proximity to or in contact with the first screen derived from the winding shaft and suppress light leakage therebetween, the leakage preventing member disposed at an opening edge opposite the first screen in the opening from which the first and second screens are derived and formed in the lower portion of the winding box in which the winding shaft is rotatably accommodated.

13. The window screen with a blind function according to claim 1, further comprising covers intended for protection and dust proofing of the screen unit, the covers added to left and right side frames of the screen frame over ranges of the side frames that the screen unit can be extended in a tensed manner in a vertical direction so as to cover left and right end surfaces between the first and second screens in a state in which a distance between the first screen and the second screen is the largest and to cover a front surface side of left and right ends of the second screen.

14. The window screen with a blind function according to claim 1, further comprising an opening-and-closing operating member configured to achieve a winding and unwinding rotation of the first and second screens by rotating the winding shaft, the opening-and-closing operating member provided at a shaft end of the winding shaft, and a stopper configured to stop the rotation of the winding shaft before the first bottom bar moves away from the lower frame after having come into contact with the lower frame of the screen frame by an excessive rotation during the unwinding rotation of the winding shaft.

15. A window screen comprising:

a first screen configured to be wound by a winding shaft;

a second screen configured to be wound by the winding shaft together with the first screen in an overlapped manner; and a plurality of slats having a predetermined width and coupled between the first screen and the second screen, the slats being coupled at ends thereof to both the first and second screens at predetermined intervals, the slats being adjustable to different orientations and being flexible so as to be capable of being wound by the winding shaft together with the first and second screens, wherein an end of each of the first and second screens is coupled to the winding shaft so as to allow the first and second screens to be wound in an overlapped manner, the first screen includes engaging strips disposed in a slit of a guide rail on each of two side frames so as to be freely slidable therein, the first and second screens include first and second bottom bars attached to the lower end of the first and second screens, respectively, at least the first bottom bar being disposed in first guide grooves of the side frames to guide vertical movement of the first bottom bar, and the first and second screens are configured so that, at least, one of the bottom bars is in contact with a lower frame with the slats in any desired inclined orientation when both screens are in an extended state.

16. The window screen according to claim 15, wherein the first and second screens and slats are configured such that unwinding rotation of the winding shaft causes downward movement of both screens and brings the first and second bottom bars to the lower frame of the screen frame simultaneously, or the first bottom bar does not reach the lower frame before the second bottom bar, further rotation of the winding shaft causes upward movement of the second screen, and the slats have an inclined orientation moving upward and downward on a second screen side when either one of the first and second bottom bars is in contact with the lower frame.

17. The window screen according to claim 16, wherein both the first and second screens are configured such that a plurality of the slats suspend the second screen with respect to the first screen when both the first and second screens move downward by the unwinding rotation of the winding shaft.

18. The window screen according to claim 17, wherein each slat includes a first coupling portion for attachment to the first screen and a second coupling portion for attachment to the second screen, the first coupling portion of one slat overlapping a height of the second coupling portion of an adjacent slat.

19. The window screen according to claim 18, further comprising second guide grooves configured to guide vertical movement of the second bottom bar, the respective the first and second guide grooves of the first and second bottom bars disposed adjacent to one another but configured so that the first and second bottom bars do not come into contact with each other.

* * * * *